US007445305B2

(12) United States Patent
Kondoh

(10) Patent No.: US 7,445,305 B2
(45) Date of Patent: Nov. 4, 2008

(54) DROPLET EJECTION APPARATUS AND DROPLET EJECTION METHOD

(75) Inventor: Yoshinao Kondoh, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 264 days.

(21) Appl. No.: 11/272,391

(22) Filed: Nov. 10, 2005

(65) Prior Publication Data

US 2006/0262150 A1 Nov. 23, 2006

(30) Foreign Application Priority Data

May 23, 2005 (JP) ..... 2005-150236

(51) Int. Cl.
*B41J 2/045* (2006.01)

(52) U.S. Cl. ..... 347/11; 347/10; 347/12

(58) Field of Classification Search ..... 347/5, 347/9, 10, 11, 12, 19
See application file for complete search history.

(56) References Cited

U.S. PATENT DOCUMENTS 6,045,209 A * 4/2000 Imai ..... 347/11

FOREIGN PATENT DOCUMENTS

| | | |
|---|---|---|
| JP | 11-314364 | 11/1999 |
| JP | 2000-218782 | 8/2000 |
| JP | 2000-238264 | 9/2000 |
| JP | 2001-026109 | 1/2001 |
| JP | 2003-053973 | 2/2003 |
| JP | 2003-285441 | 10/2003 |
| JP | 2004-223770 | 8/2004 |

* cited by examiner

*Primary Examiner*—Lam S Nguyen
(74) *Attorney, Agent, or Firm*—Fildes & Outland, P.C.

(57) ABSTRACT

A droplet ejection apparatus of the present invention includes a plurality of ejection components having a first ejection component and a second ejection component which are connected to each other so as to be capable of being charged and discharged, and a control component. The droplet ejection apparatus applies a driving signal to the plural ejection components. A first driving signal to be applied to the first ejection component has a charging process, and a second driving signal to be applied to the second ejection component has a discharging process. The control component makes a control so that the charge timing of the first driving signal and the discharge timing of the second driving signal overlap each other.

8 Claims, 19 Drawing Sheets

| | | | | | | | | | | | | | | | | | | | | | | | |
|---|---|---|---|---|---|---|---|---|---|---|---|---|---|---|---|---|---|---|---|---|---|---|---|
| PURINT DATA : ••• | 16 | 15 | 14 | 13 | 12 | 11 | 10 | 9 | 8 | 7 | 6 | 5 | 4 | 3 | 2 | 1 | | | | | | | |
| MASK DATA : ••• | 0 | 0 | 0 | 0 | 1 | 0 | 0 | 0 | 1 | 1 | 0 | 0 | 1 | 1 | 1 | 1 | | | | | | | |
| DRIVING IC1 : ••• | 16 | 15 | 14 | 13 | – | 11 | 10 | 9 | – | – | 6 | 5 | – | – | – | – | | | | | | | |
| → ••• | | | 16 | 15 | 14 | 13 | 11 | 10 | 9 | 6 | 5 | | | | | | | | | | | | |
| DRIVING IC2 : ••• | – | – | – | – | 12 | – | – | – | 8 | 7 | – | – | 4 | 3 | 2 | 1 | | | | | | | |
| → ••• | | | 12 | 8 | 7 | 4 | 3 | 2 | 1 | | | | | | | | | | | | | | |

FIG.8

S2
S1
GROUP OF WAVEFORM SIGNALS
HV2
HV1
GND
DRIVING WAVEFORM A
DRIVING WAVEFORM B
DRIVING WAVEFORM C

DISCHARGE CURRENT
R
52,54
30B
C
CHARGE CURRENT
R
52,54
30A
C
HV1 COMMON WIRING

HV2
HV1
HV1
GND
CHARGE AND DISCHARGE PERIOD
HV2→HV1 FALL
INITIAL VOLTAGE =HV2
GND→HV1 RISE
INITIAL VOLTAGE =GND

DROPLET EJECTION APPARATUS AND DROPLET EJECTION METHOD

CROSS-REFERENCE TO RELATED APPLICATION

This application claims priority under 35USC 119 from Japanese Patent Application No. 2005-150236, the disclosure of which is incorporated by reference herein.

BACKGROUND OF THE INVENTION

1. Field of the Invention

The present invention relates to a droplet ejection apparatus and a droplet ejection method. Specifically, the invention relates to a droplet ejection apparatus and a droplet ejection method that cause a plurality of ejection components to eject droplets.

2. Description of the Related Art

There have conventionally been known inkjet recording devices (so-called inkjet printers) having an ink jet recording head which, by using an actuator structured by a piezoelectric element or the like, changes the volume of (expands or contracts) a pressure generating chamber into which ink is filled, and, due to the change in pressure at the interior of the chamber caused by this change in volume, causes an ink drop to be ejected from the distal end of a nozzle which is formed to communicate with the pressure generating chamber.

The trend toward increasing the printing speeds of inkjet recording devices has strengthened in recent years. To this end, inkjet recording heads have come to be used in which the inkjet recording head is made to be longer, the number of nozzles per inkjet recording head is increased, and the nozzles are disposed so as to be lined-up in the form of a matrix, thereby enabling image formation over a wide region in a shorter period of time.

When the inkjet recording heads are made to be longer than the width of a recording sheet in such a manner, the number of ejectors composed of the pressure generating chambers, the nozzles and the like is several tends of thousands, namely, huge. The energy to be introduced, therefore, becomes excessive.

In view of such circumstances, various inkjet recording heads which reuse energy have been proposed.

Firstly, inkjet recording heads which use a tank circuit (LC circuit) which uses inductance have been proposed (see, for example, Japanese Patent Application Laid-Open (JP-A) Nos. 11-314364, 2000-218782, 2001-026109 and 2003-053973). In all the inkjet recording heads, however, driving circuits are enlarged. For the device in JP-A No. 2000-218782, the number of the inductors should be equal to the number of loads.

Secondly, inkjet recording heads that allow electric charges to move between a load capacitor and an electric charge storage capacitor have been proposed (JP-A Nos. 2000-238264, 2003-285441 and 2004-223770). Since, however, a power source relates to charging of the electric charge storage capacitor, an energy saving effect is low, and a switching component (control) becomes complicated.

SUMMARY OF THE INVENTION

The present invention has been made in view of the above circumstances and provides a droplet ejection apparatus and a droplet ejection method.

A first aspect of the present invention provides a droplet ejection apparatus. The apparatus includes: a plurality of ejection components that include a first ejection component and a second ejection component which are connected to each other so as to be capable of being charged and discharged; and a control component. In the apparatus, a driving signal is applied to each of the plurality of ejection components, a first driving signal to be applied to the first ejection component has a charging process, a second driving signal to be applied to the second ejection component has a discharging process, the control component makes a control so that a charge timing of the first driving signal and a discharge timing of the second driving signal overlap each other.

That is to say, the present invention is a droplet ejection apparatus in which a driving signal is applied to a plurality of ejection components that include the first ejection component and the second ejection component which are connected to each other so as to be capable of being mutually charged and discharged.

The first driving signal to be applied to the first ejection component has a charging step, and the second driving signal to be applied to the second ejection component has a discharging step.

The control component makes a control so that the charge timing and the discharge timing overlap each other.

The first ejection component and the second ejection component are connected to each other so as to be capable of being mutually charged and discharged.

When, therefore, the charge timing of the first driving signal to be applied to the first ejection component overlaps the discharge timing of the second driving signal to be applied to the second ejection component, the discharge from the second ejection component to which the second driving signal is applied can be utilized as the charge into the first ejection component to which the first driving signal is applied.

The first ejection component and the second ejection component are connected to each other so as to be capable of being mutually charged and discharged, and the charge timing of the first driving signal to be applied to the first ejection component overlaps the discharge timing of the second driving signal to be applied to the second ejection component. As a result, the discharge from the second ejection component can be utilized as the charge into the first ejection component, thereby reducing the energy consumption with a simple structure.

A second aspect of the present invention provides a droplet ejection method in a droplet ejection apparatus having a plurality of ejection components including a first ejection component and a second ejection component which are connected to each other so as to be capable of being charged and discharged. The droplet ejection method includes: (a) applying a driving signal to the plurality of ejection components; (b) charging a first driving signal to be applied to the first ejection component; (c) discharging a second driving signal to be applied to the second ejection component; and (d) making a control so that a charge timing of the first driving signal and a discharge timing of the second driving signal overlap each other.

According to the present invention, the first ejection component and the second ejection component are connected so as to be capable of being charged or discharged, and the charge timing of the first driving signal to be applied to the first ejection component overlaps the discharge timing of the second driving signal to be applied to the second ejection component. As a result, the discharge from the second ejection component can be utilized as the charge into the first ejection component, thereby reducing the energy consumption with a simple structure.

BRIEF DESCRIPTION OF THE DRAWINGS

A preferred embodiment of the present invention will be described in detail based on the following figures, wherein:

FIG. 8 is a schematic diagram showing states of the print data and the mask data according to the embodiment of the present invention, and states of data transfer of the print data at shift registers in two driving ICs corresponding to adjacent unit structures (ejector groups);

DETAILED DESCRIPTION OF THE INVENTION

Embodiments of the present invention will be described in detail hereinafter with reference to the drawings.

Figure 1:
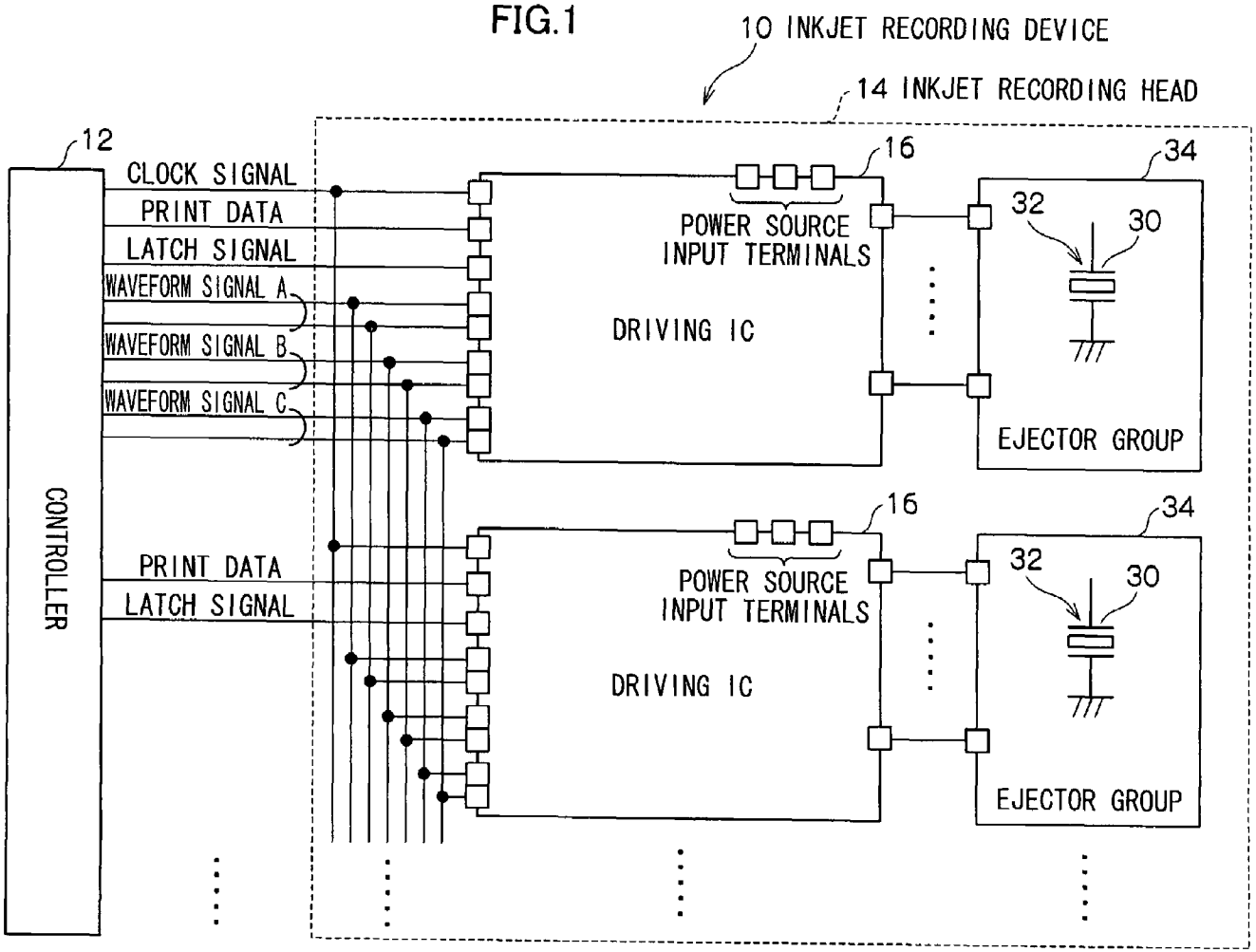
FIG. 1 is a schematic diagram showing main structures of an inkjet recording device according to an embodiment of the present invention.

FIG. 1 is a diagram showing main structures of the inkjet recording device 10 as the droplet ejection apparatus according to the present embodiment. Mainly the structures at the periphery of the inkjet recording head, except for a recording sheet conveying system, are illustrated in FIG. 1.

As shown in FIG. 1, the inkjet recording device 10 according to the present embodiment has a controller 12 as a control component, which governs the operations of the entire inkjet recording device 10, and an inkjet recording head 14, which ejects ink drops on the basis of supplied print data. The inkjet recording head 14 has plural ejector groups 34 and driving ICs (Integrated Circuits) 16. The ejector groups 34 are structured such that plural ejectors 32 are arranged two-dimensionally. The ejectors 32 eject ink drops due to the deformation of piezoelectric elements (piezo elements) 30 provided individually thereat as ejection components. The driving ICs 16 are provided so as to correspond to the respective ejector groups 34 respectively.

The inkjet recording head 14 according to the present embodiment is an elongated structure whose width is substantially equal to the width of a recording sheet. Namely, the present inkjet recording device 10 is structured as a so-called FWA (Full-Width Array) type inkjet recording device which carries out recording while conveying only the recording sheet, with the inkjet recording head 14 remaining fixed.

The ejector 32 according to the present embodiment is structured so as to include: a pressure generating chamber in which ink is filled; an ink ejecting opening which communicates with the pressure generating chamber and which can eject ink; and an actuator which has a vibrating plate structuring a portion of a wall surface of the pressure generating chamber and expanding or contracting the pressure generating chamber by vibrating, and has the piezoelectric element 30 which vibrates the vibrating plate by deformation due to voltage applied thereto in accordance with image data expressing the image to be recorded.

All of the driving ICs 16 provided at the inkjet recording head 14 are connected to the controller 12. The control of the operations of the driving ICs 16 is carried out by the controller 12 by using clock signals, print data, and latch signals, as well as a driving signal A, a driving signal B and a driving signal C to be described later (FIGS. 14A to 14C), each of which is a pair of signals, and the like.

Figure 2:
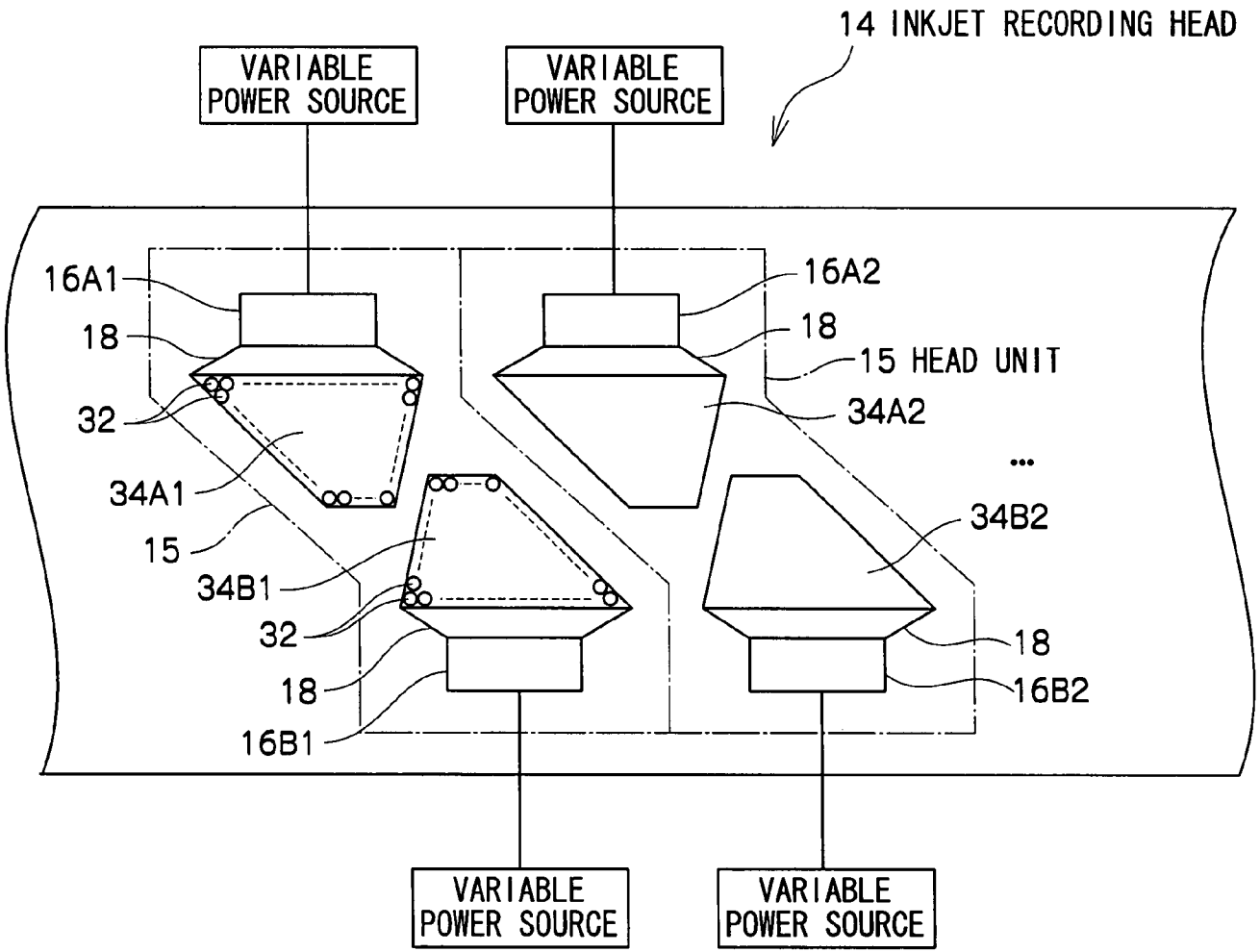
FIG. 2 is a plan view showing the schematic structure of an inkjet recording head according to the embodiment of the present invention.

A plan view showing the schematic structure of the inkjet recording head 14 according to the present embodiment is shown in FIG. 2.

As shown in FIG. 2, at the inkjet recording head 14 according to the present embodiment, each of the ejector groups (blocks) 34A1, 34B1, 34A2, 34B2, and so on, which are structured by plural ejectors 32 being arranged two-dimensionally, is a unit structure. The plural unit structures are disposed, with respect to a predetermined one direction (the longitudinal direction (elongated direction) of the inkjet recording head 14), such that partial regions at the end portions of the ejector groups which are disposed at adjacent unit structures, overlap one another.

The driving ICs 16A1, 16B1, 16A2, 16B2, and so on, are provided individually in a one-to-one correspondence with the ejector groups 34A1, 34B1, 34A2, 34B2, and so on. The ejector group and the corresponding driving IC are electrically connected by a connecting wire 18. Hereinafter, the ejector groups 34A1, 34B1, 34A2, 34B2, and so on, may be abbreviated as "the ejector group 34", other than in cases of designating a specific ejector group. Further, hereinafter, the driving ICs 16A1, 16B1, 16A2, 16B2, and so on, may be abbreviated as "the driving IC 16", other than in cases of designating a specific driving IC. Note that voltage is applied to respective ICs 16 from a variable power source to be described later.

The configuration of the region where the ejector group 34 according to the present embodiment is disposed is a trapezoidal configuration in which the angles of the two inclined sides connecting the top side and the floor side are different from one another. Further, in the inkjet recording head 14 according to the present embodiment, a pair of the ejector groups 34 structure a head unit 15 as a unit part, due to the respective top sides of the pair of ejector groups 34 being disposed so as to oppose one another across a longitudinal direction central line of the inkjet recording head 14, and the corresponding ICs 16 being disposed integrally therewith. The inkjet recording head 14 is structured in a state in which the plural head units 15 are lined-up in the longitudinal direction.

Figure 3:
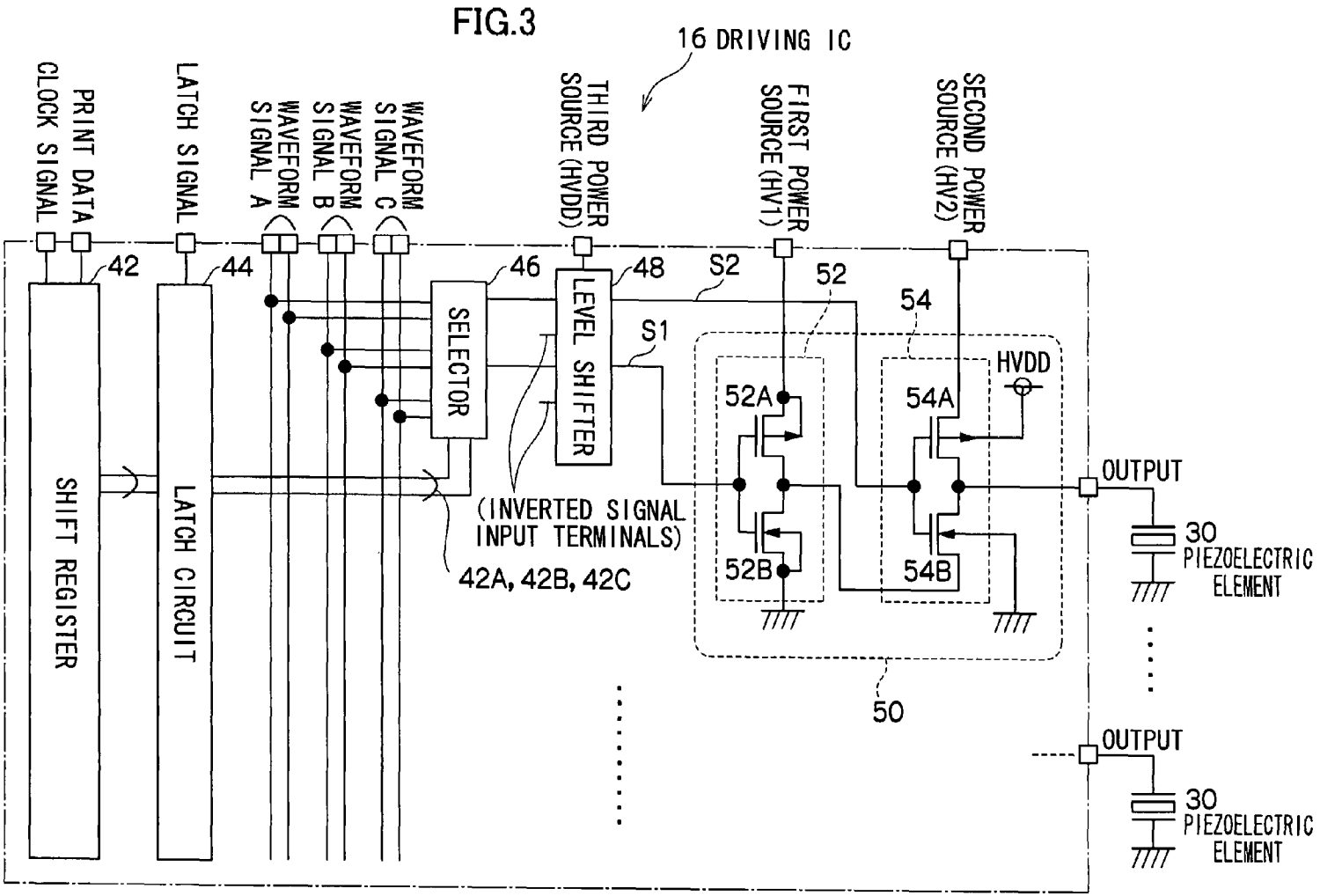
FIG. 3 is a block diagram (a partial circuit diagram) showing main structures of a driving IC according to the embodiments of the present invention.

The structure of the driving IC 16 according to the present embodiment is shown in FIG. 3.

As shown in FIG. 3, the driving IC 16 according to the present embodiment has a shift register 42, a latch circuit 44, a selector 46, a level shifter 48, and a driving waveform generating circuit 50.

A clock signal and print data outputted from the controller 12 are inputted to the shift register 42, and a latch signal is inputted to the latch circuit 44.

The print data selects one (of the pair of signals) of the driving signal A, the driving signal B and the driving signal C, and the print data is serial data formed from a driving signal A selection signal 42A, a driving signal B selection signal 42B, and a driving signal C selection signal 42C. The driving signal A selection signal 42A, the driving signal B selection signal 42B, and the driving signal C selection signal 42C are each a signal expressing one bit data which is "0" or "1". The driving signal A selection signal 42A is a signal which is "1" when the driving signal A is selected, and is "0" when the driving signal A is not selected. The driving signal B selection signal 42B is a signal which is "1" when the driving signal B is selected, and is "0" when the driving signal B is not selected. The driving signal C selection signal 42C is a signal which is "1" when the driving signal C is selected, and is "0" when the driving signal C is not selected.

Namely, the print data is 3-bit serial data, which is "100" when the driving signal A is selected, "010" when the driving signal B is selected, and "001" when the driving signal C is selected. This print data is inputted to the shift register 42 continuously a number of times equaling the sum of the number of ejectors 32 which are included in the corresponding ejector group 34 and the numbers of ejectors 32 of the adjacently-disposed ejector groups 34 which ejectors 32 overlap in the short side direction of the inkjet recording head 14.

Note that, hereinafter, explanation will be given of a case in which a driving waveform is supplied to a single piezoelectric element 30. However, the same holds for the other piezoelectric elements 30 as well, and therefore, description relating to these other piezoelectric elements 30 will be omitted.

The shift register 42 converts the inputted print data, which is the 3-bit serial data, into 3-bit parallel data, and outputs the parallel data to the latch circuit 44.

In accordance with the input of a latch signal, the latch circuit 44 latches (self-holds) the parallel data outputted from the shift register 42.

The driving signal A, the driving signal B, and the driving signal C are inputted from the controller 12 to the selector 46 as object-of-selection signals, and the parallel data of the print data latched by the latch circuit 44 is inputted to a select terminal. Accordingly, the selector 46 selects, from among the driving signal A, the driving signal B, and the driving signal C, the driving signal for which selection is instructed by the print data, and outputs the selected driving signal.

The waveform signal output terminal of the selector 46 is connected to the level shifter 48. The waveform signal outputted from the selector 46 is level-converted and outputted by the level shifter 48. Note that electric power of a predetermined voltage level (a predetermined level exceeding 40V in the present embodiment) HVDD is supplied to the level shifter 48 from a third power source. The level shifter 48 level-converts the waveform signal selected by the print data to a voltage level corresponding to the voltage level HVDD.

Figure 4:
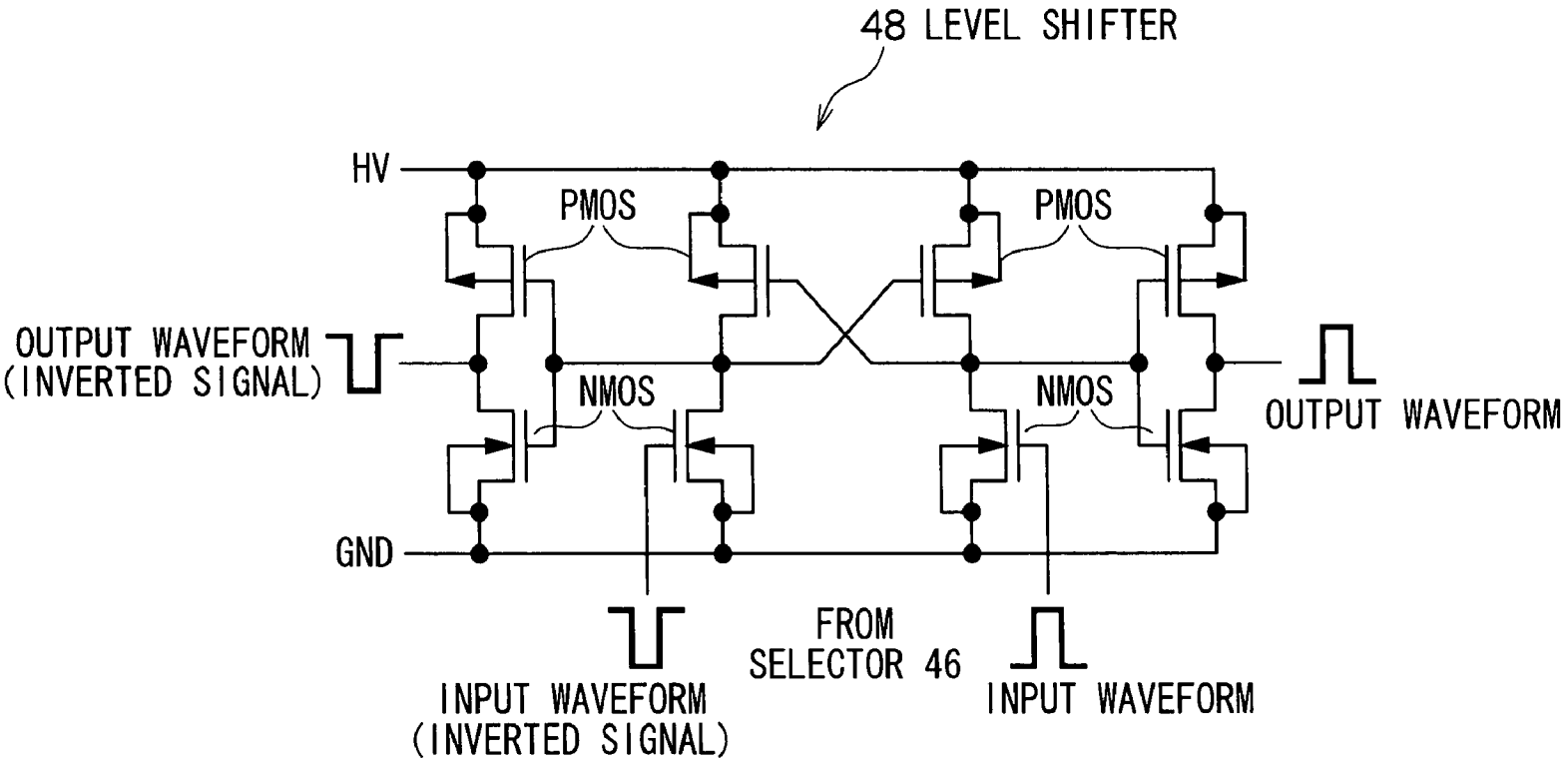
FIG. 4 is a circuit diagram showing the structure of a level shifter according to the embodiment of the present invention.

A conventionally-known structure can be used as the level shifter 48. However, in the present embodiment, the circuit structure shown in FIG. 4 using four groups of series circuits formed by P-channel MOS FETs (hereinafter, "PMOS") and N-channel MOS FETs (hereinafter, "NMOS") is used as the level shifter 48. Note that the circuit shown in FIG. 4 corresponds to one of the pair of waveform signals inputted from the selector 46. Therefore, two of these circuits are actually required. Further, the circuit shown in FIG. 4 can also handle level conversion of the signal obtained by inverting that one waveform signal, but this portion is not used in the present embodiment.

As shown in FIG. 3, the driving waveform generating circuit 50 according to the present embodiment has a first signal generating circuit 52 and a second signal generating circuit 54.

The first signal generating circuit 52 according to the present embodiment is structured as an inverter circuit structured by connecting in series a PMOS 52A and an NMOS 52B. Similarly, the second signal generating circuit 54 is structured as an inverter circuit structured by connecting in series a PMOS 54A and an NMOS 54B.

Namely, the drains of the PMOS 52A and the NMOS 52B are connected to one another, and the gates of the PMOS 52A and the NMOS 52B are connected. Similarly, at the second signal generating circuit 54 as well, the drains of the PMOS 54A and the NMOS 54B are connected to one another, and the gates of the PMOS 54A and the NMOS 54B are connected.

Here, electric power which is a predetermined voltage level HV1 (in the present embodiment, a predetermined level within the range of from 10V to 30V) from a first power source which is a variable power source to be described later is supplied to the source of the PMOS 52A of the first signal generating circuit 52. The source of the NMOS 52B is earthed, and is ground level. Further, one output terminal of the level shifter 48 is connected to respective gates of the PMOS 52A and the NMOS 52B. A waveform signal S1, which is one of the pair of waveform signals selected by the selector 46 and which is level-converted by the level shifter 48, is inputted thereto.

Accordingly, at the first signal generating circuit 52, when the signal level of the waveform signal S1 inputted from the level shifter 48 is high level, the PMOS 52A is off and the NMOS 52B is on. Therefore, the voltage level of the outputted voltage is ground level. In contrast, when the signal level of the waveform signal S1 inputted from the level shifter 48 is low level, the PMOS 52A is on and the NMOS 52B is off. Therefore, the voltage level of the outputted voltage is voltage level HV1. As a result, the waveform of the voltage outputted from the first signal generating circuit 52 is the same as the inverted waveform of the waveform signal S1 inputted from the level shifter 48, and the voltage outputted from the first signal generating circuit 52 has two voltage levels which are ground level and the voltage level HV1.

Electric power which is a predetermined voltage level HV2 (in the present embodiment, a predetermined level within the range of from 20V to 40V) from a second power source which is a variable power source to be described later is supplied to the source of the PMOS 54A of the second signal generating circuit 54. The connection point (drain) of the PMOS 52A and the NMOS 52B at the first signal generating circuit 52 is connected to the source of the NMOS 54B. Accordingly, the inverter output of the first signal generating circuit 52 is applied to the source of the NMOS 54B. Further, the other output terminal of the level shifter 48 is connected to respective gates of the PMOS 54A and the NMOS 54B. A waveform signal S2, which is the other of the pair of waveform signals selected by the selector 46 and which is level-converted by the level shifter 48, is inputted thereto.

Accordingly, at the second signal generating circuit 54, when the signal level of the waveform signal S2 inputted from the level shifter 48 is high level, the PMOS 54A is off and the NMOS 54B is on. Therefore, the voltage level of the outputted voltage (i.e., the driving waveform) is the same as the voltage outputted from the first signal generating circuit 52 (the waveform is the same as the inverted waveform of the waveform signal S1 inputted from the level shifter 48, and the voltage has two voltage levels which are the ground level and the voltage level HV1). In contrast, when the signal level of the waveform signal S2 inputted from the level shifter 48 is low level, the PMOS 54A is on and the NMOS 54B is off. Therefore, the voltage level of the outputted voltage (the driving waveform) is voltage level HV2. As a result, the voltage (driving waveform) outputted from the second signal generating circuit 54 is a combination of the voltages which are outputted respectively from the first signal generating circuit 52 and the second signal generating circuit 54 in accordance with the pair of waveform signals S1, S2 inputted from the level shifter 48, and has three voltage levels which are ground level, the voltage level HV1, and the voltage level HV2.

Figures 5A, 5B, 5C:
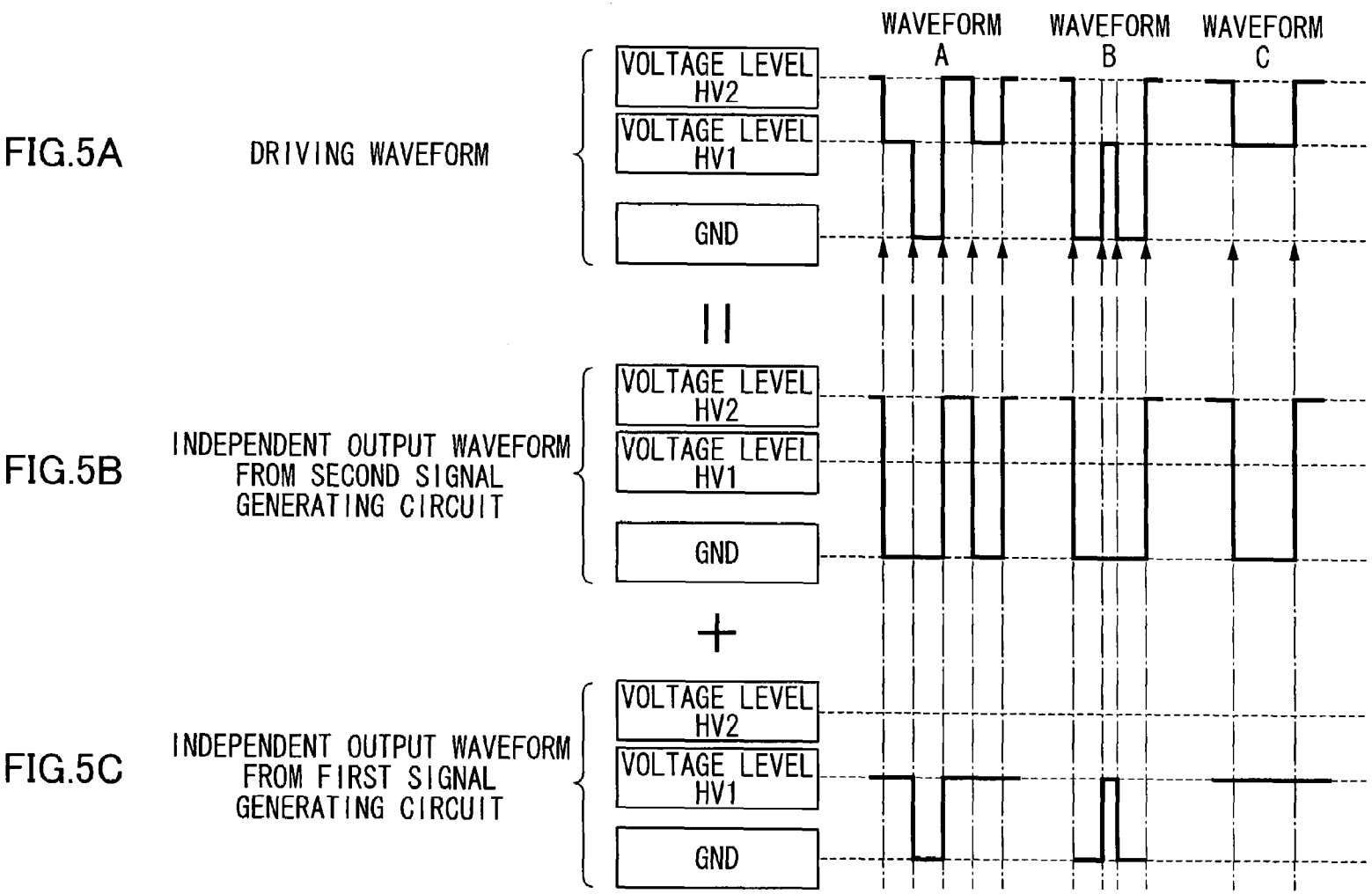
FIG. 5A is a waveform diagram showing an example of a driving waveform according to the embodiment of the present invention.
FIG. 5B is a waveform diagram showing an example of an output waveform of a single second signal generating circuit which is needed in order to generate the driving waveform according to the embodiment of the present invention.
FIG. 5C is a waveform diagram showing an example of an output waveform of a single first signal generating circuit which is needed in order to generate the driving waveform according to the embodiment of the present invention.

FIGS. 5A to 5C show an example of a driving waveform applied to the piezoelectric element 30, and examples of an output waveform of the single first signal generating circuit 52 and an output waveform of the single second signal generating circuit 54 which are needed in order to generate the driving waveform.

As shown in FIGS. 5A to 5C, when it is desired to make the voltage level of the driving waveform the voltage level HV2, the voltage level of the output waveform from the second signal generating circuit 54 is made to be the voltage level HV2. Accordingly, in this case, it suffices to make the waveform signal S2, which is inputted to the second signal generating circuit 54, low level. Note that, in this case, because the output of the first signal generating circuit 52 does not affect the output of the second signal generating circuit 54, the level of the waveform signal S1 inputted to the first signal generating circuit 52 is not limited.

When it is desired to make the voltage level of the driving waveform the voltage level HV1, the voltage level of the output waveform from the first signal generating circuit 52 must be made to be the voltage level HV1, and the voltage level of the output waveform from the second signal generating circuit 54 also must be made to be the voltage level HV1. Accordingly, in this case, the waveform signal S1 inputted to the first signal generating circuit 52 must be made to be low level, and the waveform signal S2 inputted to the second signal generating circuit 54 must be made to be high level.

Further, when it is desired to make the voltage level of the driving waveform ground level, the voltage level of the output waveform from the first signal generating circuit 52 must be made to be ground level, and the voltage level of the output waveform from the second signal generating circuit 54 also must be made to be ground level. Accordingly, in this case, the waveform signal S1 inputted to the first signal generating circuit 52 must be made to be high level, and the waveform signal S2 inputted to the second signal generating circuit 54 also must be made to be high level.

Table 1 is a truth table showing operation of the driving waveform generating circuit 50 according to the present embodiment. Note that, in Table 1, S1 indicates the waveform signal inputted to the first signal generating circuit 52, S2 indicates the waveform signal inputted to the second signal generating circuit 54, and OUT indicates the voltage level of the driving waveform which is supplied to the corresponding piezoelectric element 30 from the second signal generating circuit 54.

TABLE 1

| S1 | S2 | OUT |
|---|---|---|
| X | L | HV2 |
| L | H | HV1 |
| H | H | GND |

When generating the waveform signals S1, S2 to be inputted to the first signal generating circuit 52 and the second signal generating circuit 54 respectively, it suffices to, on the basis of the truth table of Table 1, generate the pairs of the driving signal A, the driving signal B and the driving signal C such that the driving waveform which is ultimately desired is obtained, and to supply the driving signals to all of the driving ICs 16.

Figures 14A, 14B, 14C:
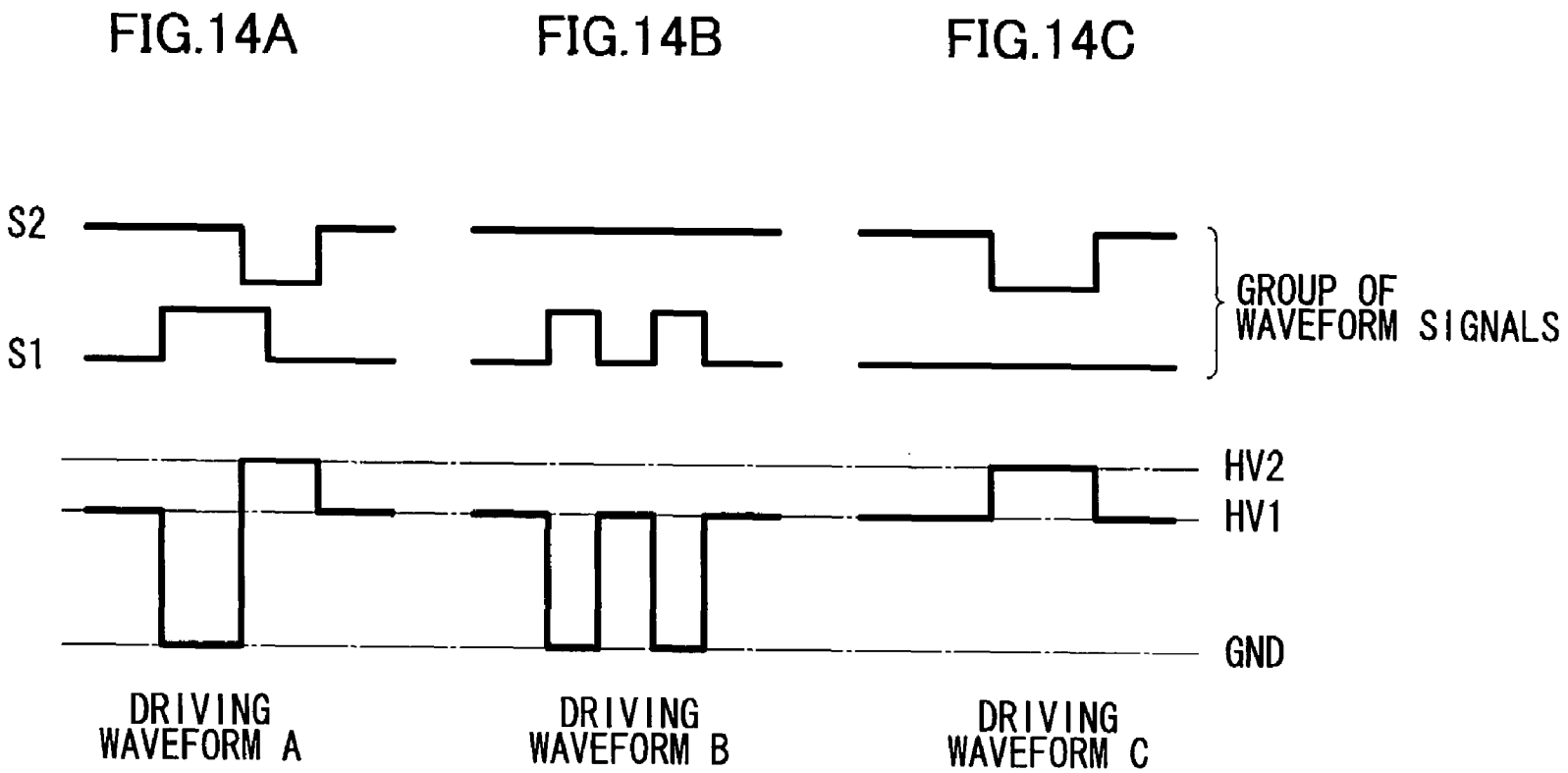
FIGS. 14A to 14C are waveform charts showing examples of waveform signals to be input into a driving waveform generating circuit of the driving ICs, and driving waveforms generated by the waveform signals according to the embodiment of the present invention.

Note that FIGS. 14A to 14C show examples of the waveform signal S1 inputted to the first signal generating circuit 52 and the waveform signal S2 inputted to the second signal generating circuit 54, as well as the driving waveform generated by these waveform signals.

In the inkjet recording device 10 according to the present embodiment, the three types of "large drop", "medium drop", and "small drop" may be used as the types of the ejecting amounts of the ink drops which are ejected by driving the piezoelectric element 30. The controller 12 may generate the driving signal A, the driving signal B, and the driving signal C respectively as three groups of waveform signals which can generate driving waveforms corresponding to these three types of ejecting amounts respectively, and these signals are inputted to the respective driving ICs 16. Here, FIG. 14A indicates the driving signal A and "large drop" is ejected in this case. FIG. 14B indicates the driving signal B and "small drop" is ejected in this case. FIG. 14C indicates the driving signal C and ink is not ejected in this case.

Figure 15:
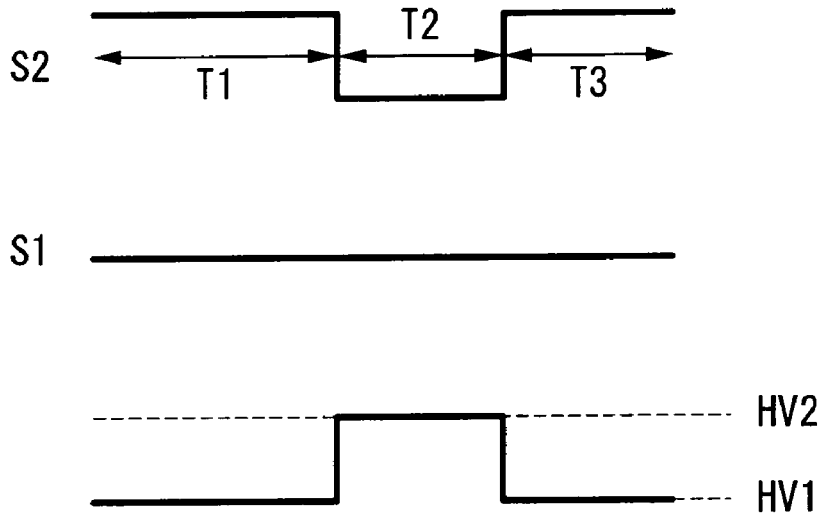
FIG. 15 is a diagram showing an example where the time at which the waveform signals in FIG. 14C are formed is changed.

In the present embodiment, the controller 12 can change the waveforms of the driving signals A, B and C. The driving signal C shown in FIG. 14C will be explained as an example. As shown in FIG. 15, the driving signal C can be divided into the time T1 for which the voltage HV1 is applied until it rises to the voltage HV2, the time T2 for which the voltage HV2 is applied until it falls to the voltage HV1, and the time T3 for which the voltage HV1 is held. In this embodiment, the times T1 to T3 can be controlled. That is to say, the waveform signal S1 is in low level and the level of the waveform signal S2 is changed so that the driving signal C can be formed. In this embodiment, therefore, the controller 12 controls the timing of the level state of the waveform signal S2, so that the waveform of the driving signal C can be changed.

In the inkjet recording device 10 according to the present embodiment, the relationship between the voltage level HVDD of the electric power supplied from the third power source and the voltage level HV2 of the electric power supplied from the second power source is (voltage level HVDD>voltage level HV2). The relationship between the voltage level HV2 and the voltage level HV1 of the electric power supplied from the first power source is (voltage level HV2>voltage level HV1).

The shift register 42 provided at the driving IC 16 according to the present embodiment is structured so as to be able to hold, at one time, the same number of print data as the number of the ejectors 32 which are the objects of driving. In contrast, as described above, a number of print data which is equal to the number of ejectors 32 which are the objects of driving plus the numbers of ejectors 32 overlapping in the short side direction of the inkjet recording head 14 at the adjacent ejector groups 34, is inputted continuously to the shift register 42. Accordingly, print data, which is of an amount within a range of greater than or equal to the amount of print data which can be held by the shift register and equal to or less than two times the amount of print data which can be held by the shift register 42, are inputted to the driving IC 16, in accordance with the angle of each inclined side of the trapezoid which is the shape of the region where the ejector group 34 is disposed.

In the inkjet recording device 10 according to the present embodiment, the print data inputted to each driving IC 16 from the controller 12 is inputted in a state in which the print data, which drives the ejector group 34 which is disposed at the corresponding unit structure, contains only the print data for the ejectors 32 which are included in mutually-overlapping regions of the ejector groups 34 disposed at the unit structures adjacent to that unit structure. Therefore, at the driving circuit 16, only the print data which drives the ejector group 34 which that driving IC 16 drives, must be selectively used from the inputted print data.

In order to easily realize this, a clock pre-processing section 12C is provided at the controller 12 according to the present embodiment.

Figure 6:
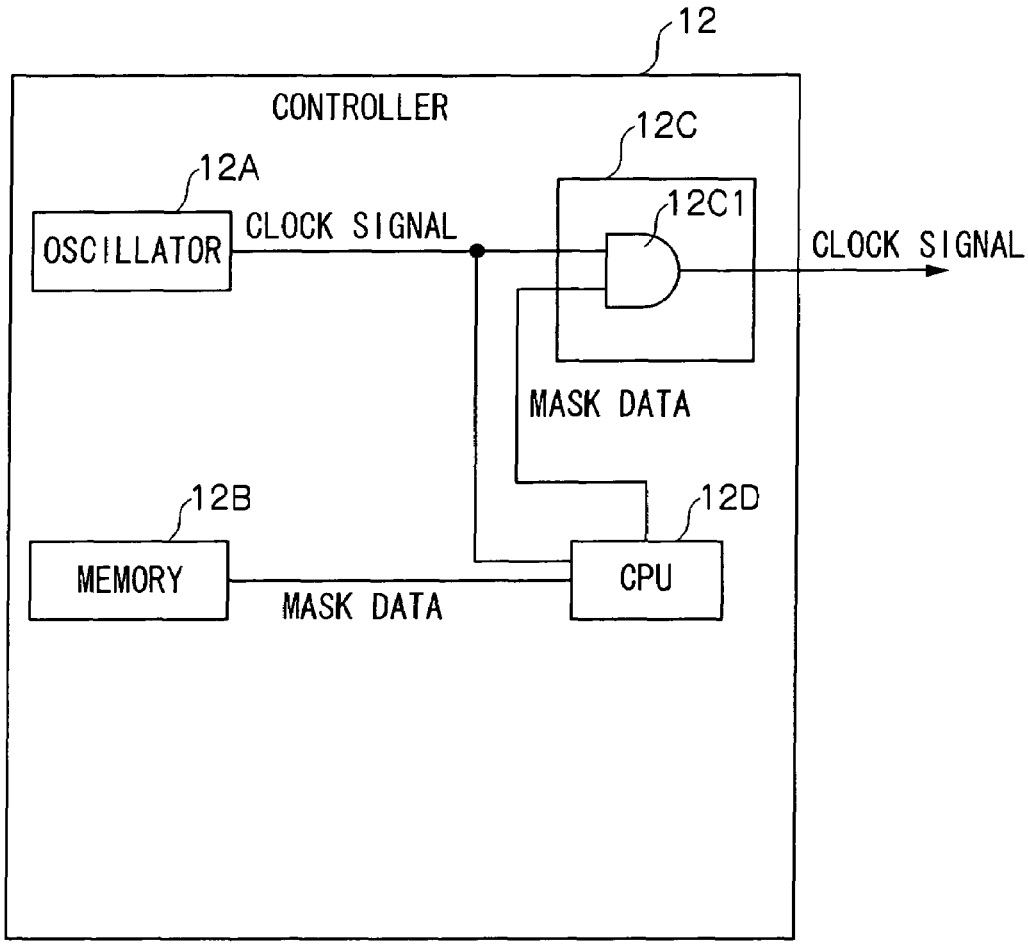
FIG. 6 is a block diagram showing the structure of a section of a controller according to the embodiment of the present invention, which section relates to the generation of a clock signal.

Namely, as shown in FIG. 6, the controller 12 has an oscillator 12A which generates a clock signal supplied to the driving ICs (an example of the driving circuit) 16, a non-volatile memory 12B (e.g., a flash memory), the clock pre-processing section 12C, and a CPU (Central Processing Unit) 12D which governs the operations of the entire controller 12.

The memory 12B is connected to the CPU 12D, and the CPU 12D can access the memory 12B. A 2-input, 1-output AND gate 12C1 is provided at the clock pre-processing section 12C. The output terminal of the oscillator 12A, which output terminal outputs the clock signal, is connected to one input terminal of the AND gate 12C1, whereas the CPU 12D is connected to the other input terminal of the AND gate 12C1. The output terminal of the oscillator 12A which outputs the clock signal is also connected to the CPU 12D. The output terminal of the AND gate 12C1 supplies the clock signal to the driving ICs 16.

Mask data is stored in advance in the memory 12B. Of the clock signals inputted to the driving IC 16, the mask data makes valid to the shift register 42 only the signals corresponding to the input timings of the print data by which that driving IC 16 drives the ejector group 34 which is the object of driving, and makes invalid to the shift register 42 signals corresponding to the input timings of the other print data (i.e., the print data for the ejectors 32 which are included in the mutually-overlapping regions of the ejector groups 34 disposed at the adjacent unit structures). Note that, in the mask data according to the present embodiment, '1' is used as data corresponding to the aforementioned timings at which the signals are made valid, and '0' is used as the data corresponding to the aforementioned timings at which the signals are made invalid.

Figure 7A:
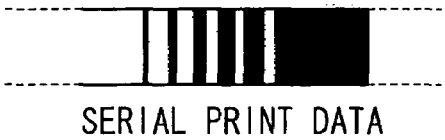
FIG. 7A is a schematic diagram showing states of output timings of print data according to the embodiment of the present invention.
Figure 7B:
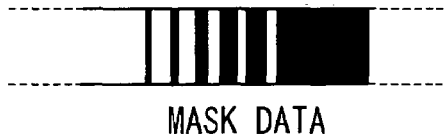
FIG. 7B is a schematic diagram showing states of output timings of mask data according to the embodiment of the present invention.

The CPU 12D reads-out the mask data from the memory 12B, and as schematically shown as an example in FIGS. 7A and 7B, synchronizes the mask data with the clock signals inputted from the oscillator 12A, and serially outputs the read-out mask data to the AND gate 12C1 in a state in which the mask data is synchronized with the input timings of the print data to the shift register 42 of the driving IC 16. In this way, of the clock signals inputted to the driving IC 16 from the AND gate 12C1, only the signals corresponding to the input timings to the shift register 42 of the print data which drive the ejector group 34 which is the object of driving of that driving IC 16 are made valid, and the signals corresponding to the input timings to the shift register 42 of the other print data are made invalid. Accordingly, at each driving IC 16, a driving waveform which drives only the ejector group 34 which is the object of driving of that IC 16, is generated, and only that ejector group 34 is driven.

FIG. 8 schematically shows the states of the print data and the mask data, and the states of data transfer of the print data at the shift registers 42 of the two driving ICs 16 corresponding to adjacent unit structures (ejector groups 34). Note that FIG. 8 illustrates a case in which the same print data 1, 2, and so on (in actuality, each is the aforementioned 3-bit serial data) is serially inputted to these two driving ICs 16, and the illustrated mask data is applied to one of the driving ICs 16, and the inverse data of that mask data is applied to the other of the driving ICs 16. Further, in FIG. 8, the "-" symbol indicates that data transfer does not occur in the shift register 42.

As shown in FIG. 8, in this case, in the shift register 42 at the one driving IC 16, data transfer is carried out in a state in which the print data, which correspond to the timings which have been made to be '0' in the mask data, are thinned out. In the shift register 42 at the other driving IC 16, data transfer is carried out in a state in which the print data, which correspond to the timings which have been made to be '1' in the mask data, are thinned out.

Figure 9:
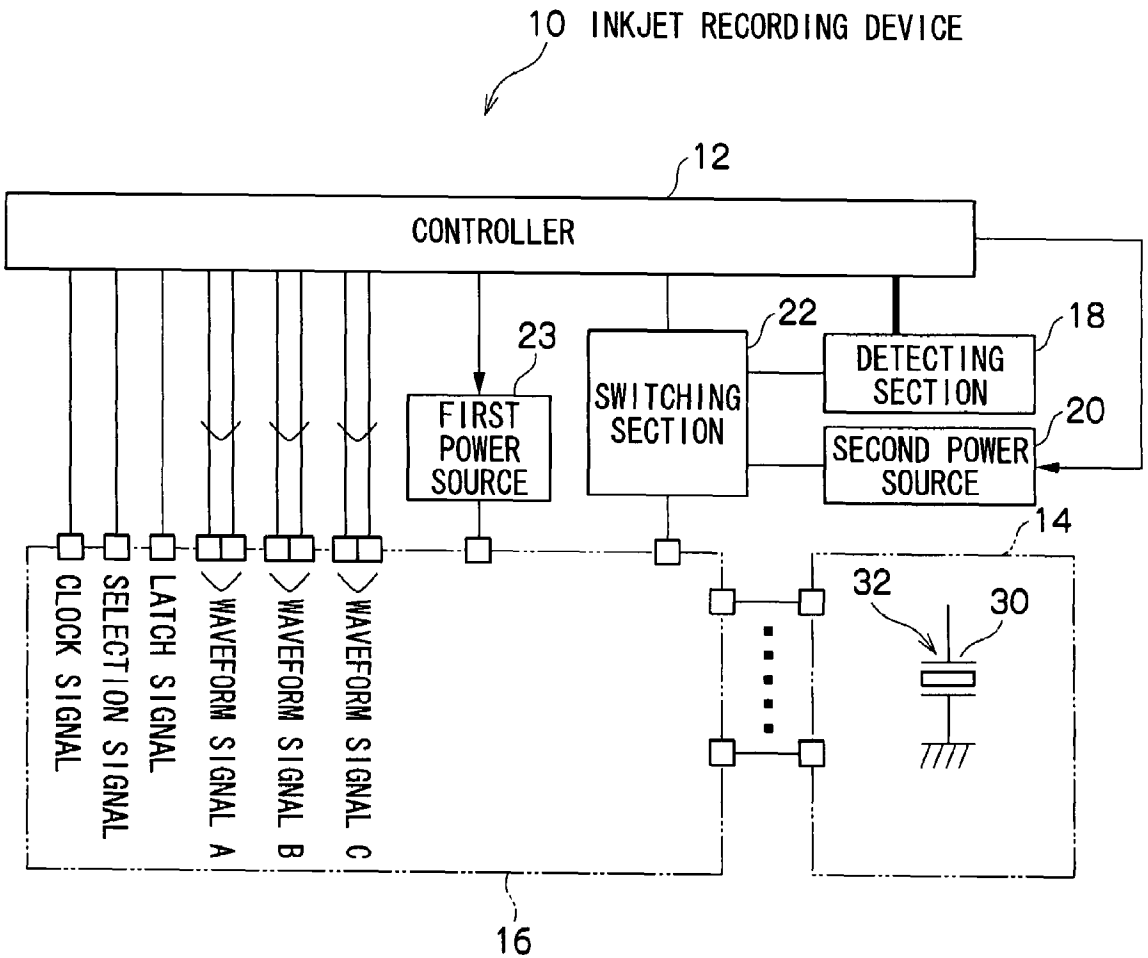
FIG. 9 is a diagram showing a connection relationship between a first power source and a second power source.

As shown in FIG. 9, the electric power is supplied from the first power sources 23 to the driving ICs 16 (voltage is applied), and the first power sources 23 are controlled by the controller 12 so that the voltages (HV1) to be applied to the corresponding driving ICs 16 from the first power sources 23 are changed.

The electric power is supplied from the second power sources 20 to the driving ICs 16 via switching sections 22

(voltage is applied), and the second power sources 20 are controlled by the controller 12 so that the voltages (HV2) to be applied from the second power sources 20 via the switching sections 22 to the corresponding driving ICs 16 are changed. The switching sections 22 are connected to detecting sections 18 which are controlled by the controller 12.

The plural first power sources 23 and the plural second power sources 20 compose the voltage applying component of the present invention.

Figure 10:
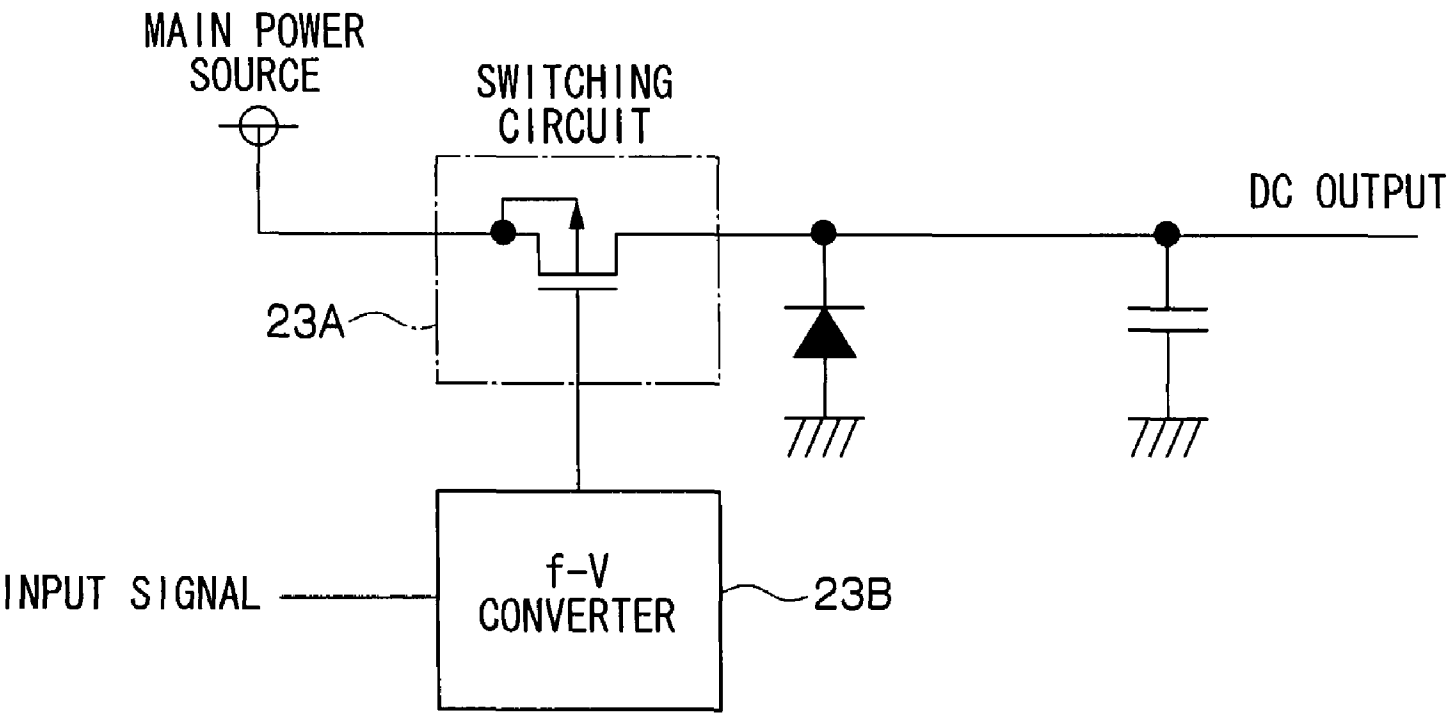
FIG. 10 is a block diagram of the first power source.

Since the first power sources 23 and the second power sources 20 have the same structure, only the structure of the first power source 23 is explained below with reference to FIG. 10, and explanation of the structure of the second power source 20 is omitted. As shown in FIG. 10, the first power source 23 is structured so as to include a switching circuit 23A which receives a supply of the electric power from a main power source, and an f (frequency)–V (voltage) converter 23B which inputs a signal from the controller 12, and changes the voltage to the switching circuit 23A according to a frequency of the input signal so as to vary an output electric power from the switching circuit 23A.

Figure 11:
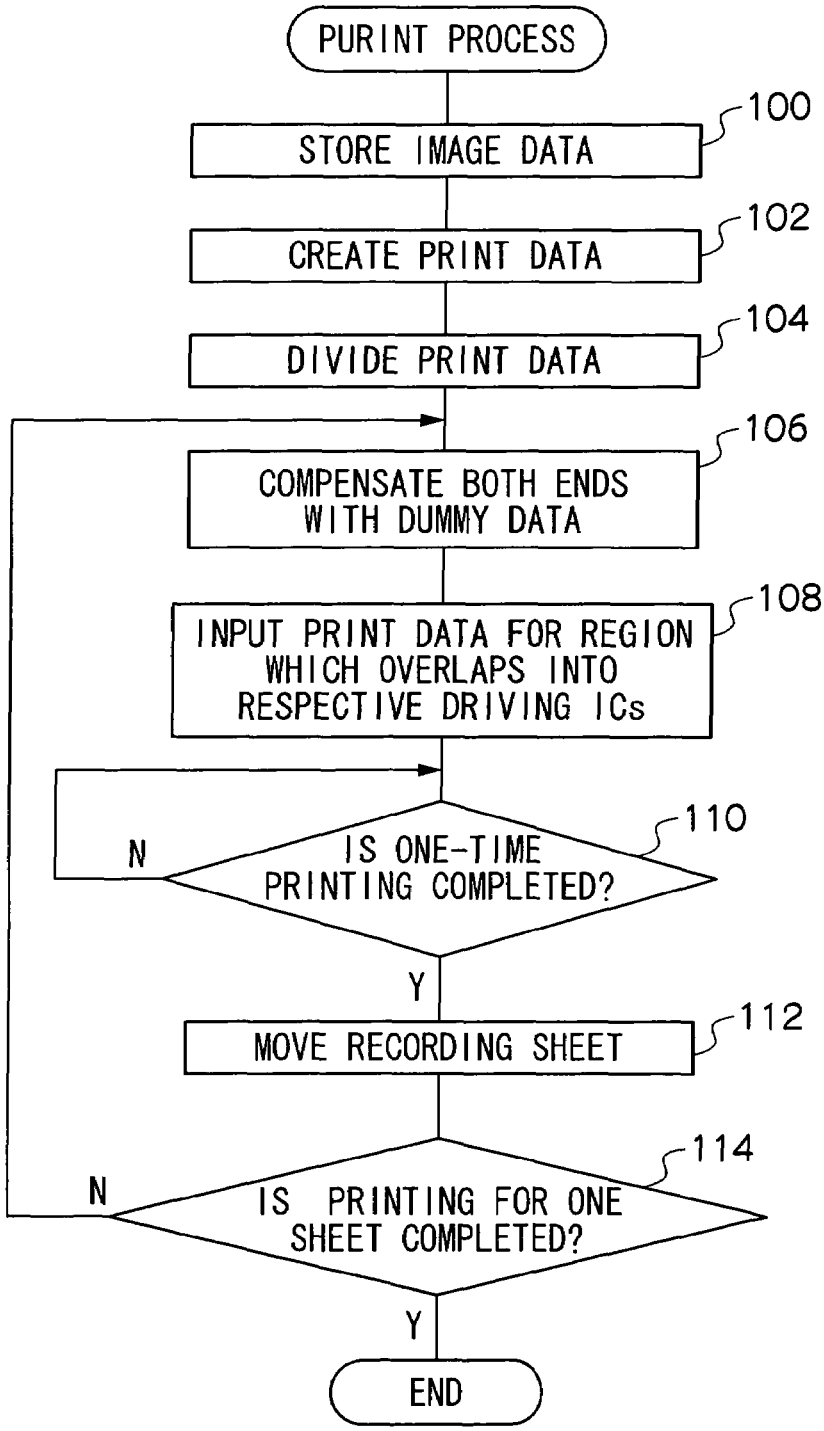
FIG. 11 is a flowchart showing the processing sequence of a print processing program according to the embodiment of the present invention.

Next, operation of the inkjet recording device 10 according to the present embodiment at the time of printing will be described with reference to FIG. 11. FIG. 11 is a flowchart showing the processing sequence of a print processing program which is executed at the CPU 12D of the controller 12 at the time when image data, which expresses the image to be printed, is inputted from an external device such as a personal computer or the like. Note that, here, in order to avoid complication, explanation will be given of a case in which an image of one page is printed.

In step 100 of FIG. 11, inputted image data is stored once in a predetermined region of the memory 12B. In a next step 102, on the basis of this image data, print data, which expresses the two-dimensional image expressed by this image data, is prepared (expanded) in a rectangular region in a two-dimensional memory space of the memory 12B.

In subsequent step 104, the print data, which is expanded in the two-dimensional memory space of the memory 12B, is divided into print data corresponding to an elongated rectangular image which is to be printed at one time by the inkjet recording head 14. This divisional print data is further divided into respective print data which are to be used at the respective ejector groups 34 provided at the inkjet recording head 14.

Figure 12:
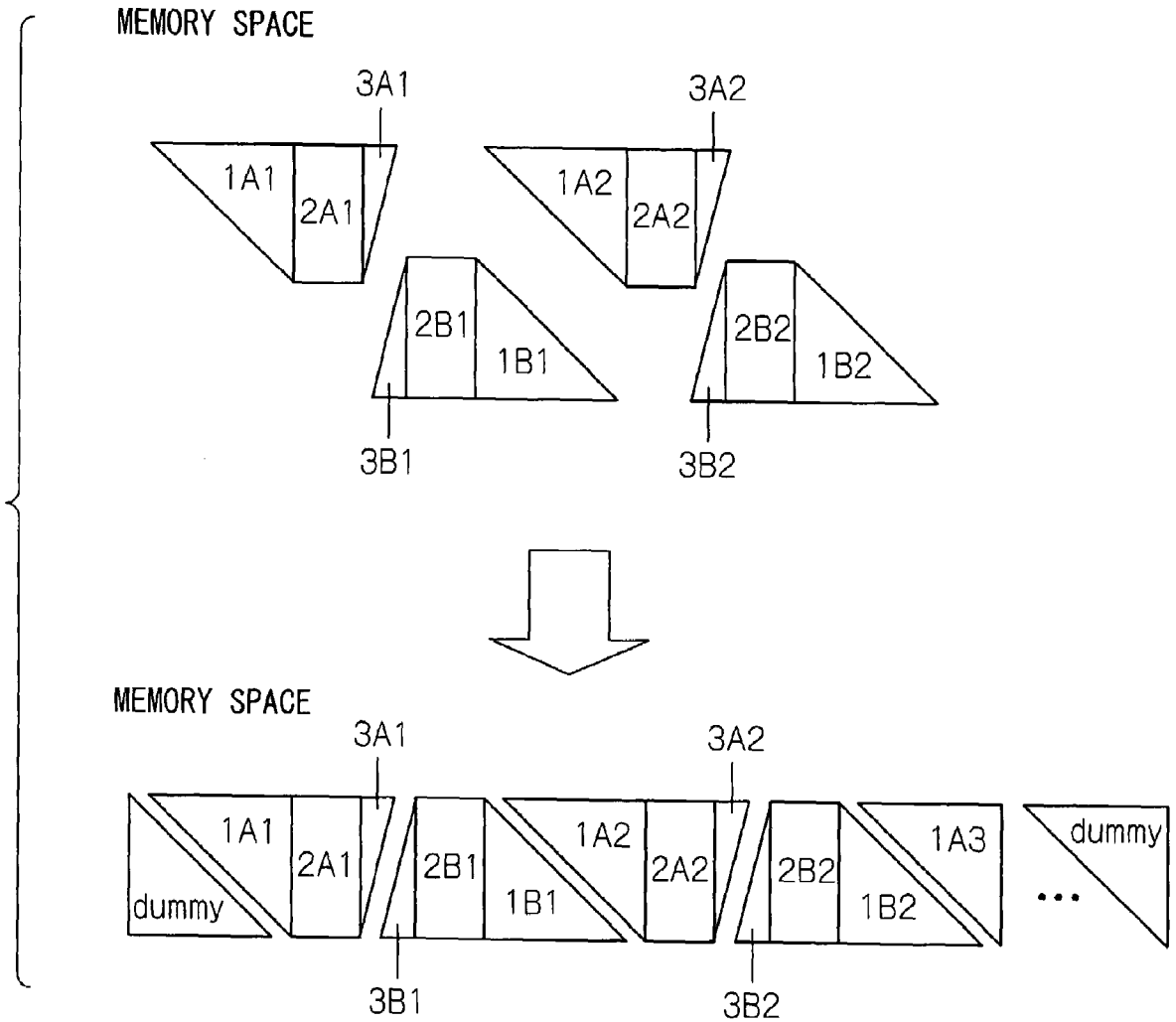
FIG. 12 is a diagram used for explaining the print processing program according to the embodiment of the present invention, and is a schematic diagram showing the transition of the state of the print data.

As shown in the upper portion of FIG. 12, in the two-dimensional memory space of the memory 12B, the respective print data which are obtained by this division exhibit a trapezoidal shape which is similar to the shape of the region where the corresponding ejector group 34 is disposed. Thus, as shown in FIG. 12, it is assumed that each of the trapezoids is in a state of having been divided into three regions wherein both end portions are triangular regions and the intermediate portion is a rectangular region.

In the example shown in FIG. 12, a state of being divided into two triangular regions which are region 1A1 and region 3A1 and one rectangular region which is region 2A1 as the three regions on the two-dimensional memory space of the print data corresponding to the ejector group 34A1 shown in FIG. 2, is assumed. Similarly, a state of being divided into two triangular regions which are region 3B1 and region 1B1 and one rectangular region which is region 2B1 as the three regions corresponding to the ejector group 34B1, is assumed. A state of being divided into two triangular regions which are region 1A2 and region 3A2 and one rectangular region which is region 2A2 as the three regions corresponding to the ejector group 34A2, is assumed. A state of being divided into two triangular regions which are region 3B2 and region 1B2 and one rectangular region which is region 2B2 as the three regions corresponding to the ejector group 34B2, is assumed.

In a next step 106, with respect to the print data corresponding to the elongated rectangular image to be printed first by the inkjet recording head 14 (hereinafter called "print data for processing"), as shown in the lower portion of FIG. 12, among the three regions on the two-dimensional memory space of the print data corresponding to the ejector groups 34 positioned at both longitudinal direction end portions of the inkjet recording head 14 (the ejector group 34 positioned at one end portion is the ejector group 34A1), dummy data (marked as "dummy" in FIG. 12) is supplemented at the regions positioned at these longitudinal direction end portions. Note that, in the inkjet recording device 10 according to the present embodiment, data which does not cause ink drops to be ejected from the ejectors 32 is used as the dummy data. However, the dummy data is not limited to this, and arbitrary data may be used as the dummy data.

Figure 13:
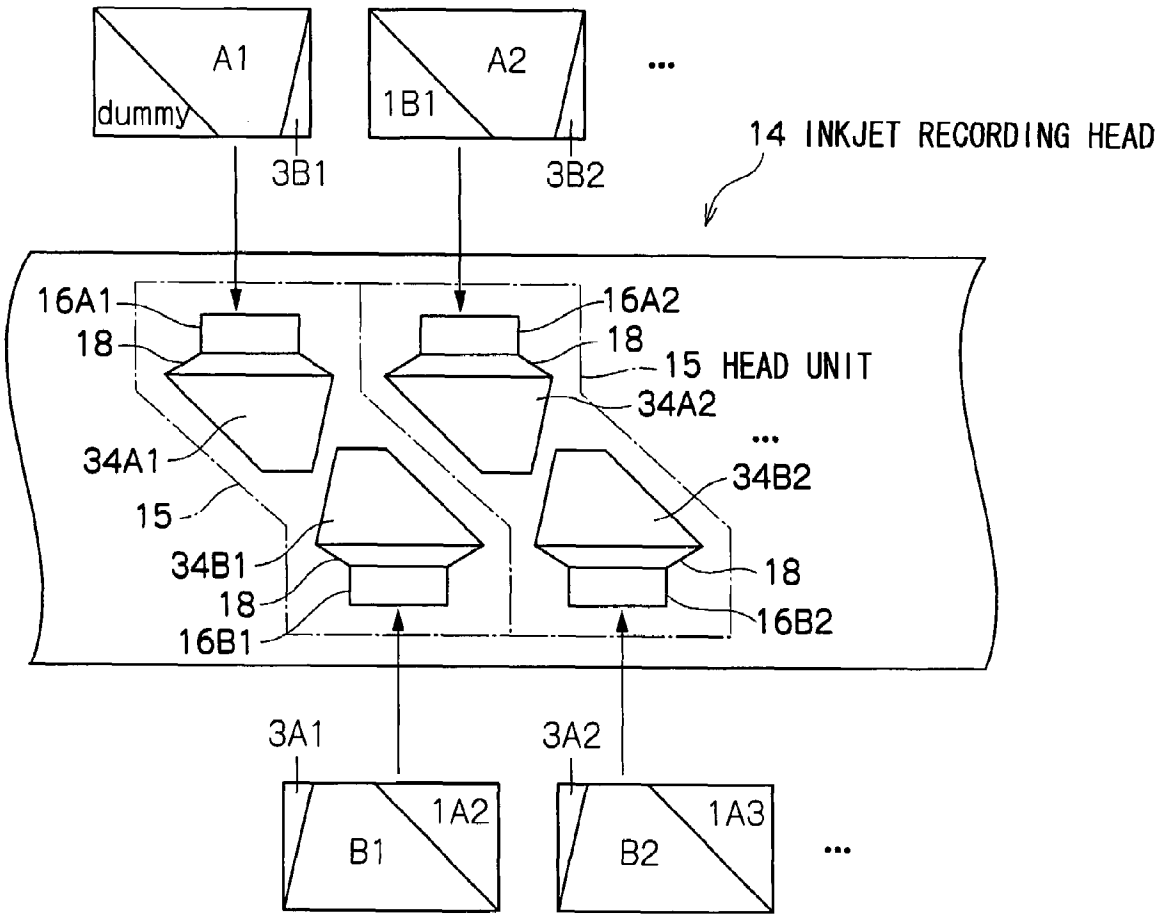
FIG. 13 is a diagram used for explaining the printing processing program according to the embodiment of the present invention, and is a schematic diagram showing the transition of the state of the print data.

In subsequent step 108, as shown in FIG. 13, the print data of each ejector group 34 is set in a state in which it includes only the print data for the ejectors 32 included in the mutually-overlapping regions of the adjacent ejector groups 34, and these data are serially inputted to the corresponding driving IC 16.

In this way, at each of the ejector groups 34, the print data which correspond to the ejectors 32 which overlap one another at ejector groups 34 which are adjacent to one another, are used in common. Note that, in FIG. 13, the region on the two-dimensional memory space of the print data corresponding to the ejector group 34A1 (the region at which the regions 1A1, 2A1 and 3A1 are combined) is denoted as 'A1', the region on the two-dimensional memory space of the print data corresponding to the ejector group 34B1 (the region at which the regions 3B1, 2B1 and 1B1 are combined) is denoted as 'B1', the region on the two-dimensional memory space of the print data corresponding to the ejector group 34A2 (the region at which the regions 1A2, 2A2 and 3A2 are combined) is denoted as 'A2', and the region on the two-dimensional memory space of the print data corresponding to the ejector group 34B2 (the region at which the regions 3B2, 2B2 and 1B2 are combined) is denoted as 'B2'.

In this case, for example, print data DA1 inputted to the driving IC 16A1, print data DB1 inputted to the driving IC 16B1, print data DA2 inputted to the driving IC 16A2, and print data DB2 inputted to the driving IC 16B2 are expressed schematically as in following formulas (1) through (4).

$$DA1=\text{dummy}+A1+3B1 \quad (1)$$

$$DB1=3A1+B1+1A2 \quad (2)$$

$$DA2=1B1+A2+3B2 \quad (3)$$

$$DB2=3A2+B2+1A3 \quad (4)$$

Here, for example, the print data DA1 and the print data DB1 are expanded as shown in following formulas (5) and (6).

$$DA1=\text{dummy}+1A1+2A1+(3A1+3B1) \quad (5)$$

$$DB1=(3A1+3B1)+2B1+(1B1+1A2) \quad (6)$$

As shown by formulas (5) and (6), the print data formed from region 3A1 and region 3B1 are shared at the ejector group 34A1 and the ejector group 34B1.

As described above, the controller 12 inputs the print data to the shift registers 42 of the respective driving ICs 16. Further, as described above, the controller 12 inputs, to the shift registers 42 of the respective driving ICs 16, clock signals in which signals corresponding to the input timings of unneeded print data are masked via the clock pre-processing section 12C. Therefore, at each driving IC 16, ejection of ink drops by only the corresponding ejector group 34 is carried out, and, as a result, the elongated rectangular image, which is printed at one time by the inkjet recording head 14, is printed onto the recording sheet.

In next step 110, the end of this one time printing is awaited. In the following step 112, the recording sheet is conveyed, in the direction orthogonal to the longitudinal direction of the inkjet recording head 14, a distance corresponding to the width, in the same direction, of the image which is printed at one time.

In the next step 114, it is determined whether or not printing of an image of one page has been completed. If the determination is negative, the routine returns to the above-described step 106. The present printing processing program ends at the point in time when the determination is affirmative. Note that, when repeating the processing of the above-described steps 106 through 114, the print data corresponding to the image region which is to be printed next is used as the print data for processing.

In the above-mentioned embodiment, the case using ink as droplets is explained as an example, but the present invention is not limited to this, and a reaction liquid, for example, can be used instead of the ink. Specifically, there is a phenomenon such that the density changes according to a coating weight of the reaction liquid, and when dispersion of the density of the reaction liquid is controlled, the invention can be applied similarly to the above. As for other applications, the present invention can be similarly applied to coating of an orientation film forming material for a liquid crystal display element, coating of fluxes, coating of adhesives, and the like.

Next, a principle whereby in the present embodiment the discharge of a certain piezoelectric element (second piezoelectric element 30A) 30 is utilized as the charge for another piezoelectric element (first piezoelectric element 30B) 30 and energy is thereby saved is explained below.

Figures 16A, 16B:
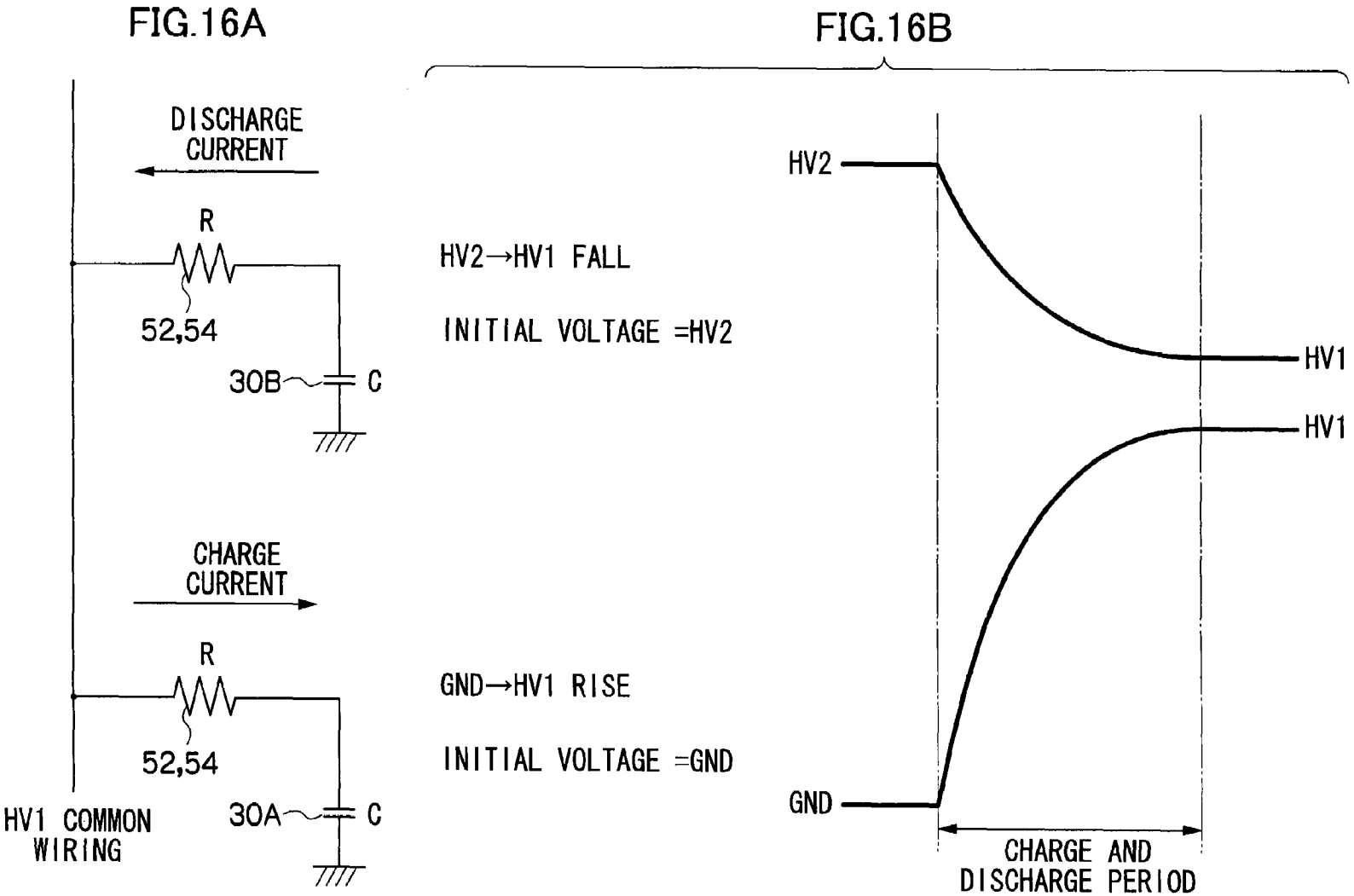
FIG. 16A is a diagram showing a state of discharge from a first piezoelectric element and charge into a second piezoelectric element.
FIG. 16B is a diagram showing a state where the discharge timing of the first piezoelectric element and the charge timing of the second piezoelectric element overlap each other.

In the present embodiment, the piezoelectric elements 30 conceptually shown in FIG. 16A are connected to power source lines L1 of the first power sources via the first signal generating circuit 52 and the second signal generating circuit 54, conceptually shown, whose synthesized resistance is indicated by R. Therefore, the piezoelectric elements 30 are connected to each other so as to be capable of being mutually charged and discharged.

Further, the driving signal (first driving signal) to be applied to the first piezoelectric element 30A has a step of charging from a ground electric potential to the first electric potential HV1, and the driving signal (second driving signal) to be applied to the second piezoelectric element 30B has a step of discharging from the second electric potential HV2, which is higher than the first electric potential HV1, to the first electric potential HV1.

As shown in FIG. 16B, a control is made so that charge timing of the first driving signal to be applied to the first piezoelectric element 30A overlaps discharge timing of the second driving signal to be applied to the second piezoelectric element 30B.

In this case, since the piezoelectric elements 30 are connected to each other so as to be capable of being charged and discharged, the discharge from the second piezoelectric element 30B can be utilized as the charge into the first piezoelectric element 30A.

Here, the energy of the first piezoelectric element 30A and the second piezoelectric element 30B is considered. An electrostatic capacity of the piezoelectric elements 30 is designated by C, and a combined resistance of the first signal generating circuit 52 and the second signal generating circuit 54 is designated by R.

When the second piezoelectric element 30B is discharged and the electric potential is changed from the second electric potential HV2 into the first electric potential HV1, electrostatic energy to be discharged is $0.5C(HV2^2-HV1^2)$. At this time, the energy consumption of the resistance R is $0.5C(HV2-HV1)^2$.

An energy difference is such that $0.5C(HV2^2-HV1^2)-0.5C(HV2-HV1)^2=C\times HV1(HV2-HV1)>0$. The second piezoelectric element 30B is, therefore, discharged, and the electric power is discharged into the power source line L1.

On the other hand, when the second piezoelectric element 30A is charged and the electric potential is changed from the ground electric potential GND into the first electric potential HV1, an introduction energy is $C\times HV1^2$.

Since the piezoelectric elements 30 are connected to each other so as to be capable of being charged and discharged and their charge and discharge times overlap, a difference of the discharge energy can be utilized.

The introduced energy from the first power source is $C\times HV1^2-C\times HV1(HV2-HV1)=C\times HV1(2HV1-HV2)$ while the charging and discharging times overlap, and thus an energy saving effect is produced. That is to say, when the first electric potential HV1 is lower than 0.5× the second electric potential HV2, a discharge amount of the second piezoelectric element 30B becomes larger than the electric energy necessary for charging the first piezoelectric element 30A. For this reason, the introduced energy becomes negative, namely, unnecessary, but since the energy of an absolute value is redundant and discarded, it is desirable that the first electric potential HV1 is not less than 0.5×the second electric potential HV2. The first electric potential HV1 is presumed to be lower than the second electric potential HV2. It is, therefore, preferable that 0.5× the second electric potential HV2<the first electric potential HV1<the second electric potential HV2.

For example, when HV1=0.75 HV2, HV1=15V, HV2=20V and C=600 pF, the introduced energy to the first piezoelectric element 30A is 135 nJ, and the energy discharged from the second piezoelectric element 30B is 45 nJ. While the charging and discharging times overlap, the energy to be introduced from the first power source can be reduced to ⅔.

When the first electric potential HV1=0.5× the second electric potential HV2, the energy to be introduced from the first power source into the first piezoelectric element 30A can be unnecessary while the charging and discharging times overlap, and this is preferable.

In the case where the first electric potential HV1 from the first power source and the second electric potential HV2 from the second power source are precisely determined with the above relationship being maintained, unnecessary ink drops occasionally fly due to printing density. In view of such a case, the printing density which is used the most is assumed in advance, namely, the first electric potential HV1 is set to be higher in the case of low density, and the first electric potential HV1 is set to be lower in the case of high density.

The first electric potential HV1 from the first power source and the second electric potential HV2 from the second power source may be fixed as long as the above relationship (0.5× the second electric potential HV2<the first electric potential HV1<the second electric potential HV2) is maintained. In the present embodiment, however, a variable power source is used. This is because the above relationship is maintained appropriately after changes in environmental temperature, dispersion of ejector characteristics and the like are taken into consideration.

Figure 17A:
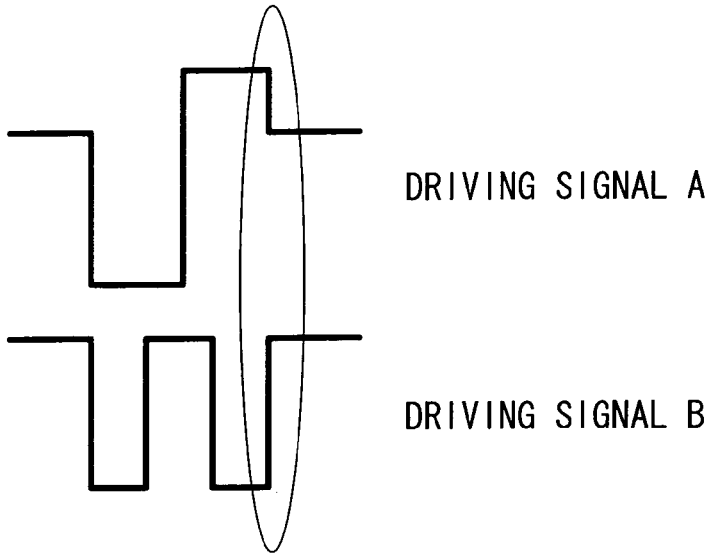
FIGS. 17A to 17C are diagrams showing plural groups of driving signals where the charge timing and the discharge timing overlap each other.
Figure 17B:
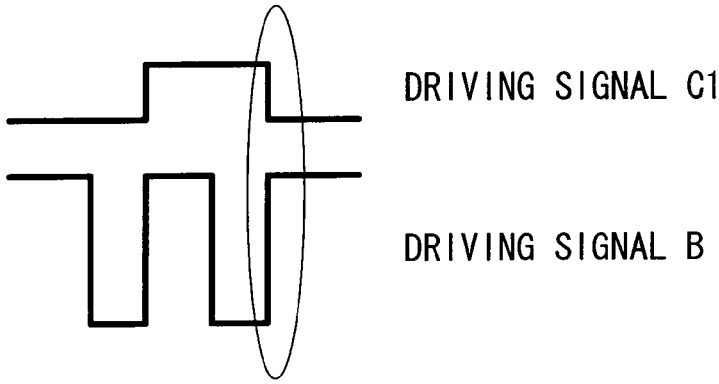
Figure 17C:
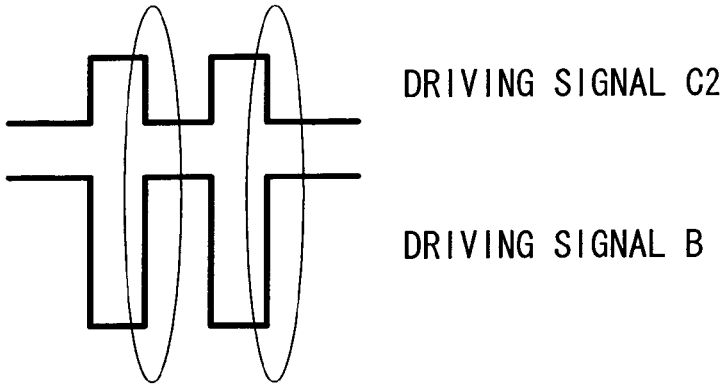

A group of driving signals with which the discharge from the second piezoelectric element 30B can be used for the charge of the first piezoelectric element 30A is, as shown in FIGS. 17A to 17C, a group of the driving signals A and B as shown in FIG. 17A, for example. It is, however, difficult to make the charging and discharging times of the driving signals A and B overlap each other. The timings of the driving signals A and B are determined so that desired drop amounts are obtained in such a manner that the driving signal A is used for a large drop and the driving waveform B is used for a small drop.

On the contrary, the driving signal C is applied to the piezoelectric elements 30 in order to perturb ink in the ink chamber, and thus any waveforms can be used as long as ink is not ejected. The driving signal C, therefore, has a comparatively high degree of freedom for the control of the timings. For example, as shown in FIG. 17B, the driving signal C may have a waveform with one rise and one fall, or as shown in FIG. 17C, may have a waveform with a plurality of rises and falls (for example, twice).

The contents of the control for the charge timing and the discharge timing to overlap each other are explained below.

The case where the control is actively made so that the charge timing overlaps the discharge timing is explained first.

Figure 18:
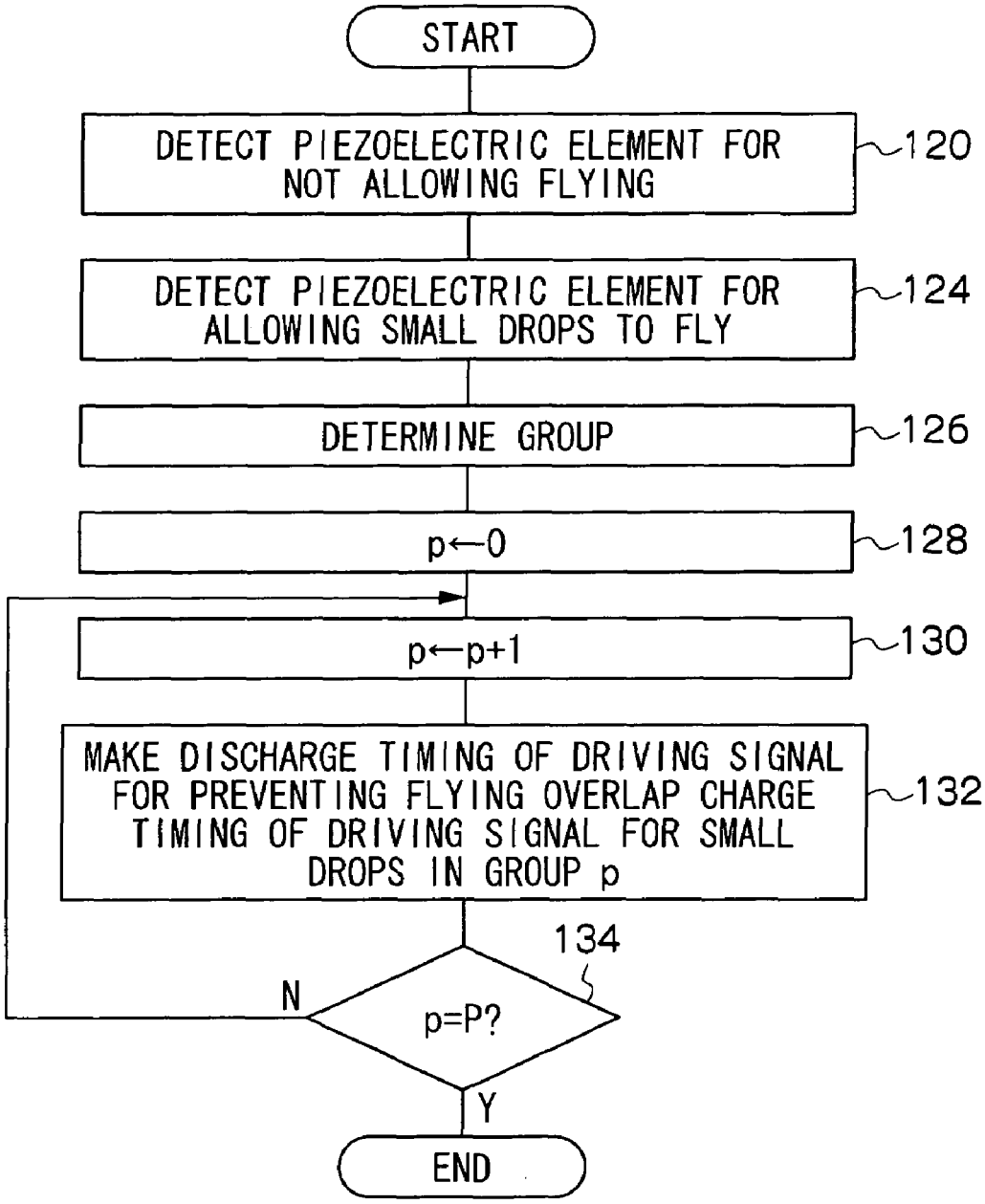
FIG. 18 is a flowchart showing a timing control routine for actively overlapping the charge timing and the discharge timing.

In the above print process (see FIG. 11), a timing control routine shown in FIG. 18 is executed at every one-time print process (steps 106 to 114).

Figure 19A:
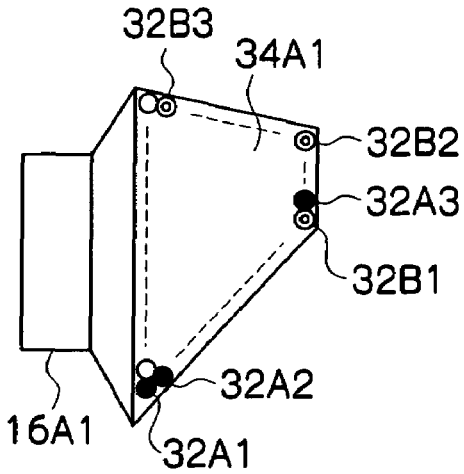
FIGS. 19A to 19C are diagrams showing states where the charge timing and the discharge timing actively overlap each other.

At step 120, a piezoelectric element 30 which does not cause ink to be ejected (to fly) is detected based on print data. For example, the ejector group 34A1 shown in FIG. 19A is explained as an example. The ejectors 32A1, 32A2, 32A3, and so on, which do not eject the ink in the ejector group 34A1 are detected.

At step 124, a piezoelectric element 30 which causes small drops to be ejected (to fly) is detected based on print data. For example, the ejector groups 34A1 shown in FIG. 19A is explained as an example. The ejectors 32B1, 32B2, 32B3, and so on, which allow ink in small drops to be ejected are detected in the ejector group 34A1.

At step 126, a group where charging and discharging are carried out is determined. In the above example, the examples are (ejector 32A1, ejector 32B1), (ejector 32A2, ejector 32B2), (ejector 32A3, ejector 32B3), and so on.

At step 128, a variable p for identifying each group is initialized, the variable p is incremented by one at step 130, and the discharge timing of the driving signal with which small drops do not fly overlaps the charge timing of the driving signal in group p at step 132. For example, in the group (ejector 32A2, ejector 32B2), the piezoelectric element 30 of the ejector 32A2 corresponds to the second piezoelectric element 30B, and the piezoelectric element 30 of the ejector 32B2 for flying small drops corresponds to the first piezoelectric element 30A.

Figure 19B:
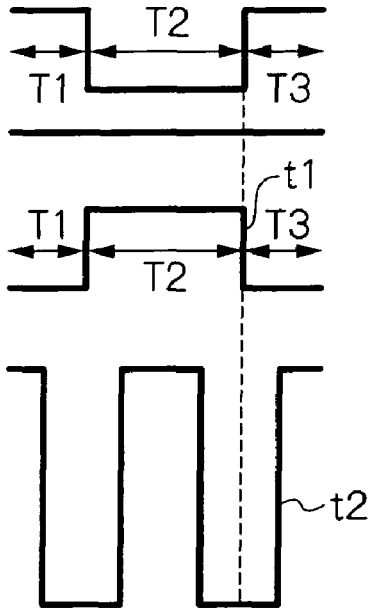
Figure 19B:
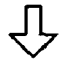

In this case, the discharge timing t1 of the driving signal C for the second piezoelectric element 30B, as shown in FIG. 19B, occasionally shifts to the charge timing t2 of the driving signal B for the first piezoelectric element 30A.

Figure 19C:
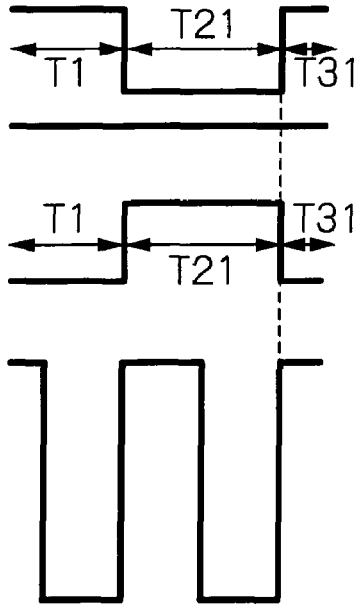

In order to overlap the discharge timing and the charge timing, the timings of the driving signals B and C may be controlled. It is not, however, preferable that the timing of the driving signal B is changed as mentioned above. In the present embodiment, therefore, as shown in FIG. 19C, the discharge timing of the driving signal C overlaps the charge timing of the driving signal B. For this reason, the time T2 in the waveform signal S2 is changed into time T21 at which the discharge timing of the driving signal C overlaps the charge timing of the driving signal B. Accordingly, the time T3 is also changed into time T31.

A determination is made whether the variable p is equal to a total number P of the groups at step 134, and when the determination is made that the variable p is not equal to the total number P of the groups, a group where the discharge timing does not overlap the charge timing is possibly present. For this reason, the sequence returns to step 130 so that the above process (steps 130 to 134) is executed. On the other hand, when the determination is made that the variable p is equal to the total number P of the groups, the discharge timing overlaps the charge timing in all the groups, and thus the process is ended. Steps 106 and hereafter in the print process (see FIG. 11) are executed.

The first piezoelectric element and the second piezoelectric element are connected to each other so as to be capable of being charged and discharged, and the charge timing of the first driving signal to be applied to the first piezoelectric element overlaps the discharge timing of the second driving signal to be applied to the second piezoelectric element. As a result, the discharge from the second piezoelectric element can be utilized as the charge to the first piezoelectric element, thereby reducing the energy consumption with a simple structure.

Figure 20A:
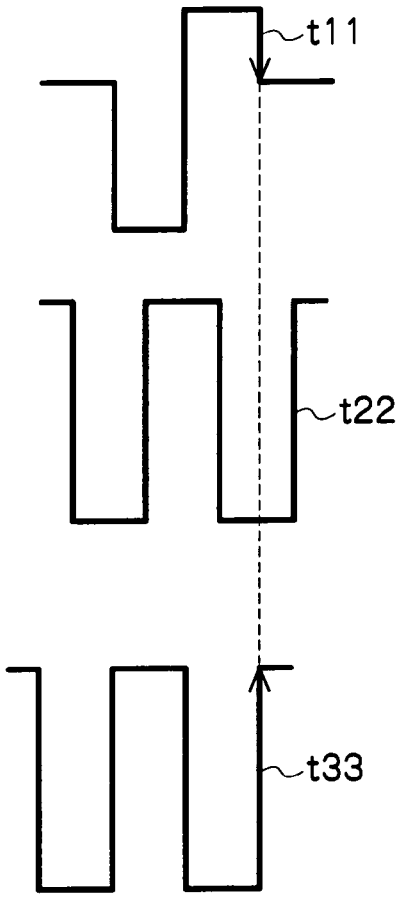
FIGS. 20A and 20B are diagrams showing states where the charge timing and the discharge timing passively overlap each other.
Figure 20B:
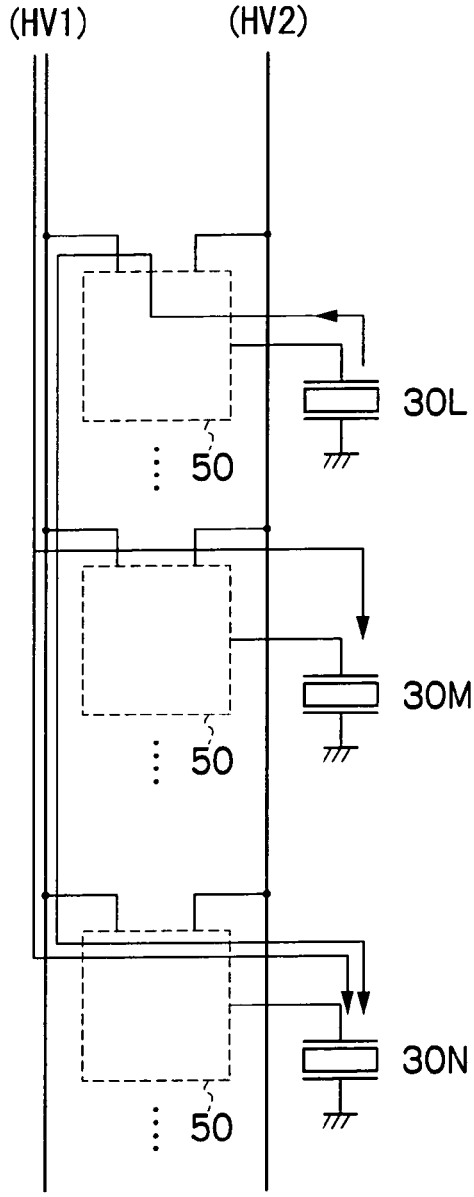

The case where the control is passively made so that the charge timing overlaps the discharge timing is explained below with reference to FIGS. 20A and 20B.

For example, the driving signal C is applied to the piezoelectric element 30L of the ejector 32 in a certain ejector group 34A1, and the driving signal B is applied to the piezoelectric element 30M of the ejector 32 in the ejector group 34A1 and to the piezoelectric element 30N of the ejector 32C in another ejector group 34A2.

In the same ejector group 34A1, the discharge timing t11 of the driving signal C to the piezoelectric element 30L does not overlap the charge timing t22 of the driving signal B to be applied to the piezoelectric element 30M. In this case, therefore, the energy cannot be utilized.

For example, however, in the ejector group 34A1, the discharge timing t11 of the driving signal C to the piezoelectric element 30L occasionally overlaps the charge timing t33 of the driving signal B to be applied to the piezoelectric element 30N of the ejector 32C in the ejector group 34A2.

In this case, the piezoelectric elements 30L, M and N are connected to the power source line L1 of the first power source, and thus the piezoelectric element 30L and the piezoelectric element 30N are connected to each other so as to be capable of being charged and discharged. When the discharge timing t11 of the piezoelectric element 30L (corresponds to the second piezoelectric element) overlaps the charge timing t33 of the piezoelectric element 30N (corresponds to the first charging element), as shown in FIG. 20B, the discharge from the piezoelectric element 30L can be utilized as the charge to the piezoelectric element 30N.

When the control is passively made so that the charge timing overlaps the discharge timing, the charge timing of the first piezoelectric element overlaps the discharge timing of the second piezoelectric element. In contrast, when the control is actively made, the group of the piezoelectric elements which can be charged or discharged is determined from the plural piezoelectric elements, and the charge timing overlaps the discharge timing in the determined group. For this reason, the energy consumption can be reduced further in the case where the control is actively made.

In the present embodiment, the timings of the driving waveforms are controlled in such a manner that the controller controls the waveform signals, but the present invention is not limited to this, and the waveform signals may be structured so that the timings overlap in advance, or an adjustment component, such as a delay circuit may be provided. In this case, the adjustment component may be present in the driving circuit (driving IC) or present between the driving circuit and the controller. Further, the invention is not limited to the case where the waveform signals are adjusted, and thus the driving waveforms may be adjusted instead of this or together therewith.

In the above-mentioned embodiment, the case where ink is used as droplets is explained as an example, but the present invention is not limited to this, and instead of ink, for example, a reaction liquid can be used. Specifically, there is a phenomenon whereby the density changes according to a coating amount of the reaction liquid, and when the dispersion of the density of the reaction liquid is controlled, the present invention can be applied in a similar manner to the above case. Alternatively, the invention can be applied to coating of an orientation film forming material for a liquid crystal display element, coating of fluxes, coating of adhesives, and the like, according to the inkjet method in a similar manner to the above case.

As described the above, the first aspect of the present invention is a droplet ejection apparatus. The apparatus includes: a plurality of ejection components that include a first ejection component and a second ejection component which are connected to each other so as to be capable of being charged and discharged; and a control component. In the apparatus, a driving signal is applied to each of the plurality of ejection components, a first driving signal to be applied to the first ejection component has a charging process, a second driving signal to be applied to the second ejection component has a discharging process, the control component makes a control so that a charge timing of the first driving signal and a discharge timing of the second driving signal overlap each other.

The driving signal has at least a predetermined electric potential portion, and the first driving signal to be applied to the first ejection component may have the step of charging from an electric potential lower than the predetermined electric potential to the predetermined electric potential. The second driving signal to be applied to the second ejection component may have a step of discharging from an electric potential higher than the predetermined electric potential to the predetermined electric potential.

Here, the ejection component is the piezoelectric element with predetermined electrostatic capacity, the predetermined electric potential is the first electric potential, and the electric potential which is higher than the predetermined electric potential in the second driving signal is the second electric potential. In this case, the energy to be introduced is proportional to the electric potential obtained by (2× the first electric potential−the second electric potential). When the first electric potential is lower than the electric potential of (0.5× the second electric potential), the discharge amount from the second ejection component becomes larger than the electric energy necessary for charging the first ejection component. For this reason, the introduction energy becomes negative, and thus unnecessary, but since the introduction energy for the absolute value is redundant and discarded, it is desirable that the first electric potential is not less than 0.5× the second electric potential. When the first electric potential and the second electric potential establish a relationship that the first electric potential=0.5× the second electric potential, the energy consumption can be reduced the most, and thus this case is desirable.

The control component may passively or actively make a control so that the charge timing and the discharge timing overlap each other.

The case where the control component actively makes a control so that the charge timing and the discharge timing overlap each other is explained.

That is to say, the control component determines the group of the first ejection component that applies the first driving signal and the second ejection component that applies the second driving signal from the plural ejection components. The control component may change at least one of the timings of the first driving signal and the second driving signal so that the charge timing and the discharge timing overlap each other in the determined group.

Here, in the case where the second driving signal is the driving signal with which droplets are not ejected from the second ejection component to which the second driving signal is applied, the control component changes the timing of the second driving signal.

The case where the control component passively makes a control so that the charge timing overlaps the discharge timing is explained.

That is to say, the first ejection component may be the ejection component which causes the charge timing of the first driving signal to be applied to the first ejection component to overlap the discharge timing of the second driving signal to be applied to the second ejection component in the plural ejection components.

In the case where the control component passively makes a control, the first ejection component is the ejection component which causes its charge timing to overlap the discharge timing of the second ejection component. On the contrary, in the case where the control component actively makes a control, the group of the first ejection component which applies the first driving signal and the second ejection component which applies the second driving signal is determined from the plural ejection components, and the charge timing and the discharge timing overlap each other in the determined group. For this reason, the energy consumption can be reduced further in the case where the control component actively makes a control.

What is claimed is:

1. A droplet ejection apparatus comprising:

a plurality of ejection components that include a first ejection component and a second ejection component which are connected to each other so as to be capable of being mutually charged and discharged, whereby the discharge from the second ejection component is utilized as the charge into the first ejection component; and a control component, wherein a driving signal is applied to each of the plurality of ejection components, a first driving signal to be applied to the first ejection component has a charging process, a second driving signal to be applied to the second ejection component has a discharging process, the control component makes a control so that a charge timing of the first driving signal and a discharge timing of the second driving signal overlap each other, the control component determines a group of the first ejection component for applying the first driving signal and the second ejection component for applying the second driving signal from among the plurality of ejection components, and changes at least one of the timings of the first driving signal and the second driving signal so that the charge timing and the discharge timing overlap each other in the determined group, the second driving signal is a driving signal by which droplets are not ejected from the second ejection component to which the second driving signal is applied, and the control component changes the timing of the second driving signal.

2. The droplet ejection apparatus of claim 1, wherein the first and second driving signals have at least a predetermined electric potential portion, the first driving signal to be applied to the first ejection component has a process of charging from an electric potential lower than the predetermined electric potential, to the predetermined electric potential, and the second driving signal to be applied to the second ejection component has a process of discharging from an electric potential higher than the predetermined electric potential, to the predetermined electric potential.

3. The droplet ejection apparatus of claim 1, wherein the control component passively or actively makes a control so that the charge timing and the discharge timing overlap each other.

4. The droplet ejection apparatus of claim 1, wherein the first ejection component is an ejection component among the plurality of ejection components where the charge timing of the first driving signal to be applied to the first ejection component overlaps the discharge timing of the second driving signal to be applied to the second ejection component.

5. A droplet ejection method in a droplet ejection apparatus having a plurality of ejection components including a first ejection component and a second ejection component which are connected to each other so as to be capable of being mutually charged and discharged, whereby the discharge from the second ejection component is utilized as the charge into the first ejection component, the droplet ejection method comprising:

(a) applying a driving signal to the plurality of ejection components;

(b) charging a first driving signal to be applied to the first ejection component;

(c) discharging a second driving signal to be applied to the second ejection component; and (d) making a control so that a charge timing of the first driving signal and a discharge timing of the second driving signal overlap each other;

wherein, in (d), a group of the first ejection component to which the first driving signal is applied and the second ejection component to which the second driving signal is applied is determined from among the plurality of ejection components, and at least one of the timings of the first driving signal and the second driving signal is changed so that the charge timing and the discharge timing overlap each other in the determined group, the second driving signal is a driving signal by which droplets are not ejected from the second ejection component to which the second driving signal is applied, and the timing of the second driving signal is changed in (d).

6. The droplet ejection method of claim 5, wherein the first and second driving signals have at least a predetermined electric potential portion, in (b), the first driving signal to be applied to the first ejection component is charged from an electric potential lower than the predetermined electric potential, to the predetermined electric potential, and in (c), the second driving signal to be applied to the second ejection component is discharged from an electric potential higher than the predetermined electric potential, to the predetermined potential.

7. The droplet ejection method of claim 5, wherein, in (d), the control is passively or actively made so that the charge timing and the discharge timing overlap each other.

8. The droplet ejection method of claim 5, wherein the first ejection component is an ejection component among the plurality of ejection components where the charge timing of the first driving signal to be applied to the first ejection component overlaps the discharge timing of the second driving signal to be applied to the second ejection component.

* * * * *